United States Patent [19]

Roth et al.

[11] 4,417,667

[45] Nov. 29, 1983

[54] LIGHTWEIGHT CONTAINER

[75] Inventors: Donald J. Roth, Westport; Charles S. Kubis, Weston, both of Conn.; John Walter, Evergreen Park, Ill.

[73] Assignee: The Continental Group, Inc., Stamford, Conn.

[21] Appl. No.: 305,668

[22] Filed: Sep. 25, 1981

Related U.S. Application Data

[63] Continuation-in-part of Ser. No. 191,225, Sep. 26, 1980, and Ser. No. 191,226, Sep. 26, 1980.

[51] Int. Cl.[3] ..... B65D 8/08; B65D 8/22

[52] U.S. Cl. ..... 220/67; 220/1 BC; 220/66; 220/70

[58] Field of Search ..... 220/66, 67, 70, 1 BC, 220/8, 458; 72/348; 413/4, 7; 229/4.5

[56] References Cited

U.S. PATENT DOCUMENTS

| | | | |
|---|---|---|---|
| 1,788,261 | 1/1931 | Werder | 413/4 X |
| 2,107,232 | 2/1938 | Blakeway | 220/458 |
| 2,197,434 | 4/1940 | McManus et al. | 220/1 BC |
| 2,330,940 | 10/1943 | Wright | 220/67 X |
| 2,338,397 | 1/1944 | Beasley | 229/4.5 |
| 2,384,810 | 9/1945 | Calleson et al. | 220/1 BC |
| 3,084,826 | 4/1963 | Ericson | 220/309 |
| 3,385,470 | 5/1968 | Dorosz et al. | 220/67 |
| 3,760,751 | 9/1973 | Dunn et al. | 72/348 |
| 3,904,069 | 9/1975 | Tonkmanian | 220/70 X |
| 4,006,838 | 2/1977 | Baumann et al. | 220/81 R X |
| 4,165,011 | 8/1979 | Holk, Jr. | 220/67 |
| 4,175,670 | 11/1979 | Reynolds et al. | 220/66 |
| 4,280,268 | 7/1981 | Gordon | 220/8 X |
| 4,313,545 | 2/1982 | Maeda | 220/1 BC |

FOREIGN PATENT DOCUMENTS

| | | | |
|---|---|---|---|
| 2751039 | 5/1978 | Fed. Rep. of Germany | 220/70 |
| 1098389 | 7/1955 | France | 220/66 |
| 598486 | 10/1959 | Italy | 220/66 |
| 729326 | 12/1966 | Italy | 220/5 A |

*Primary Examiner*—Allan N. Shoap
*Attorney, Agent, or Firm*—Charles E. Brown

[57] ABSTRACT

A novel pressure holding container formed of thin sheet metal of the order of between 10 and 4 mils wherein the container has a bottom portion and a top portion, the bottom portion having a body and an integral bottom, and in one embodiment having a necked-in upper end of the body which tightly fits into a lip portion of the lower end of the top portion and is adhesively bonded thereto and wherein the upper portion of the top portion has a toro-conical shape which under pressure wants to expand it into a spherical shape and thus through beam loading on the lip portion imposes compressive stresses thereon and holds in compression the adhesive which is interposed between the lip and the annulus of the necked-in portion of the body which is loaded in tension by the internal pressure in the container. In another embodiment of the invention, the body has no necking-in at its upper edge and is of uniform diameter from end to end and is tightly fitted into the lip of the upper portion and adhesively bonded thereto. The joint in each embodiment has thin lapped metal sections which deflect and transmit lateral loads imposed on the body and/or lip and thus attenuate the forces without imposing peeling forces on the adhesive. The conical sections are either stepped or smooth for different force loadings particularly in the application of different types of closures thereto.

23 Claims, 48 Drawing Figures

48
25
44
50
45
40
51
42
22
20
16
46
3
15
36
14
12
34
26
32
28
8
30
6
1
2
49
24
18
10
60

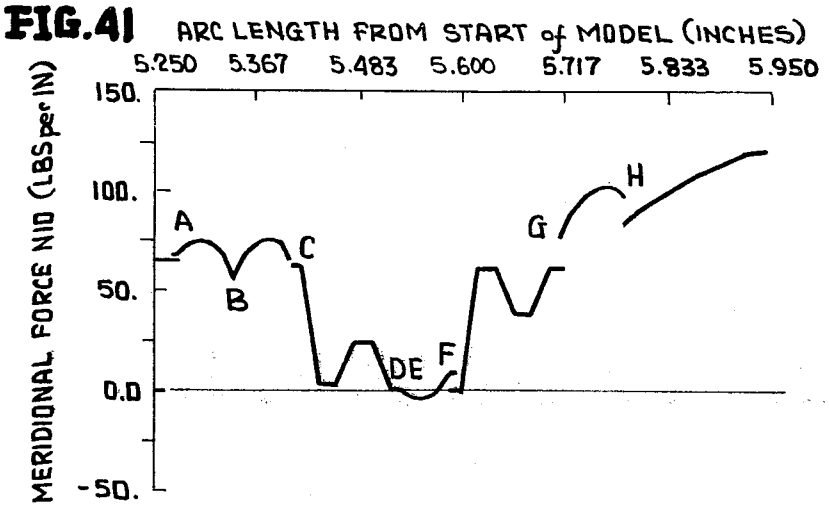
FIG.41
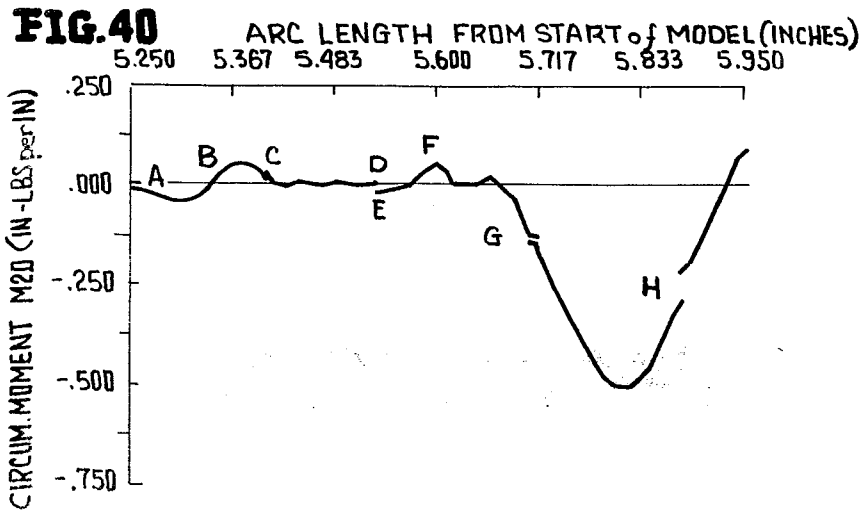
FIG.40
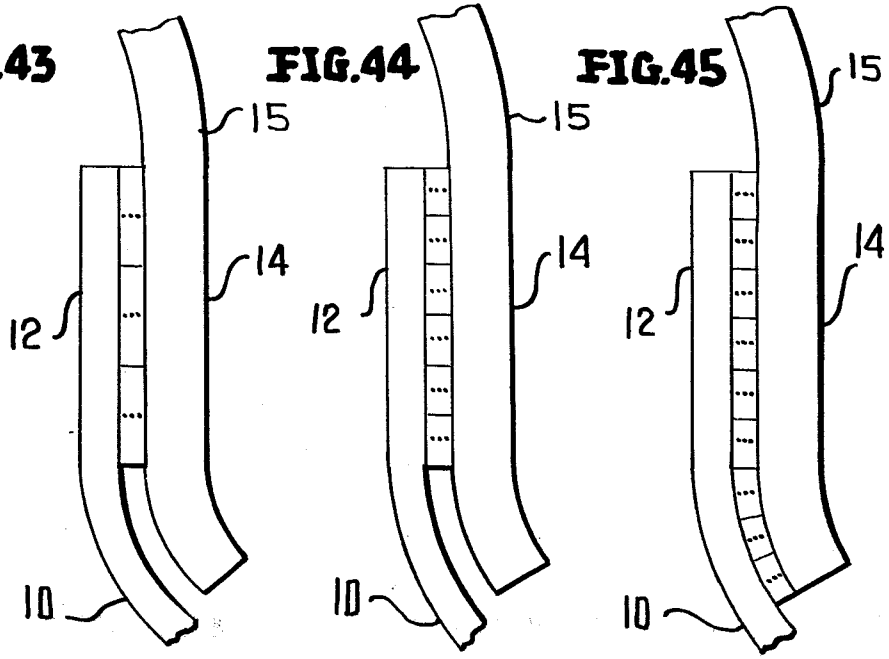
FIG.43
FIG.44
FIG.45
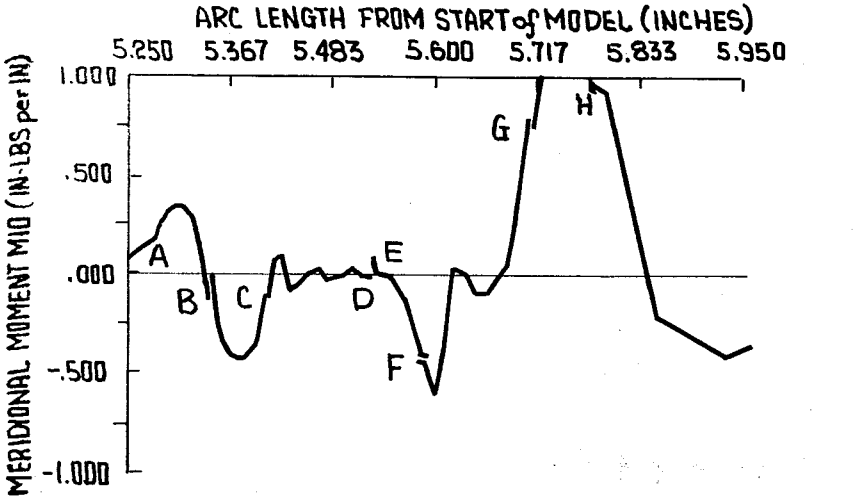
FIG.42

LIGHTWEIGHT CONTAINER

This application is a continuation-in-part of our copending applications Ser. No. 191,225 and 191,226, each entitled LIGHTWEIGHT CONTAINER and each filed Sept. 26, 1980.

BACKGROUND OF THE INVENTION

Containers of the type under consideration are primarily made of aluminum and have a cylindrical body with an integral bottom. The top is usually closed by a generally flat end member of different alloy than the body which is usually H19-3004. The present commercial aluminum containers including ends weigh approximately 0.040-0.045 pounds each. The single service beverage cans of the 1960's included a three-piece steel body, steel bottom and an aluminum top. The most popular can of the 1970's was an all aluminum drawn and wall-ironed can with a double seamed top. The top was of a different alloy than the can body.

DESCRIPTION OF THE PROBLEM

Aluminum, because of its light weight and ductility and being able to be easily cast, is finding growing uses, most recently in the automotive industry. Material costs are rapidly escalating and the supply is dwindling. Various structures have been made to shape the bottom of the can to obtain more volume with less strength. Inverted or the champagne bottoms on the 1970 vintage cans have been used to hold the pressure, but this design is wasteful of the material in that a taller than necessary can must be provided necessitating additional material to obtain the desired volume. Furthermore, the flat top end requires the use of a strong alloy aluminum material having a magnesium content. The compositions of the body and that of the end of each can, being different, complicates recycling of the cans.

Steel cans on the other hand, because of the thickness of the metal used, require high tonnage presses and tools must be more frequently replaced. When thick metal is used, the costs and carrying weights become excessive. In order to obtain an easy opening feature, steel cans invariably use aluminum tops which complicates recycling. The aluminum and the steel must be separated which is a time consuming costly process. The attractiveness of steel for cans is in the lower cost of the metal and its greater availability.

SOLUTION OF THE PROBLEM

A primary object of the invention is to provide a pressure vessel design to create an optimum container.

The concave bottoms of the principal current designs 0.014 inch thick are replaced in the can of this invention formed of aluminum by a convex bottom about 0.008 inch thick which obtains increased volume with less aluminum.

The double seam which also consumes aluminum is eliminated by substituting an adhesive telescoped joint.

The top or dome of the new container is about 9 mils thick compared to the double seam flat top of 14 mils. The heavy flange thickness of 7 mils of double seamed cans is not required and is reduced to 4 mils.

A total package weight of about 20 pounds per one thousand cans is obtained versus 38–40 pounds for the present lightest weight aluminum cans.

The two pieces of the new can are assembled at the can plant and later filled through the small drink hole using conventional bottle fillers.

It is postulated that although aluminum cans 4 mils thick are about the thinnest that can be commercially made, steel cans 2 to 2½ mils in wall thickness are feasible. The elimination of a special alloy for the can ends by making the can of one alloy produces a uni-alloy can, therefore making it more valuable as scrap for recycling.

The improved can remains cleaner, has better pourability and can be reclosed and resealed.

The new container provides a novel top which increases container volume and can be as easily used for 16 ounce cans as well as for 12 ounce cans or even 10 ounce cans merely by lengthening or shortening the can body.

A feature of the new container is that it can be made on present existing equipment without excessive capital investment.

A dome-shaped top member is used having a novel shape including a cone-like center portion and a peripheral annulus or band portion which is joined to the center portion by a toroidal section, the annulus preferably terminating at its lower edge in an outwardly turned flange which not only strengthens the annulus against radial deflection but also provides on its underside a bell-shaped pilot surface for guiding the end member into an interference fit assembly with a necked-in section formed at the upper end of the body portion of the can, the necked-in section terminating at its lower end in an outwardly extending shoulder which merges into the can body section therebelow, the shoulder providing a stop which the flange at the lower end of the top portion engages as the top is fully entered over the necked-in section which is secured to the top portion by a suitable preferably thermoplastic or thermosetting adhesive of well known kind.

Advantage is taken of the shape of the top and of the thinness of about 0.009 inch and short axial length of the top with respect to the body length of the container to which the top is applied by shaping the top in a manner such that on filling the container with pressurized beverage internal pressure forces are exerted on the cone section of the top to cause beamloading of the cone section to exert inward forces on the lip at the base of the cone portion to assist the adhesive by applying compressive forces thereagainst and to the portion of the opposing body portion at the telescoped junction of the body and top. Peeling forces on the adhesive in the bonded telescoped junction as would ordinarily occur under internal pressure loading are thus eliminated. Various configurations of the top portion are shown which obtain specific benefits as hereinafter defined.

In conducting studies with respect to the cans, with particular reference to the adhesive, it has been unexpectedly found that the adhesive, when placed in compression, exhibits a marked increase in sheer strength.

In 12 ounce cans, the body has a diameter of 2.60 inches and an axial length of 4 inches whereas in the 16 ounce can the body length or height is 4.75 inches.

In order to obtain a beaming action wherein the forces of expansion acting on the conical portion of the top produce compressive forces on the adhesive, the toroidal section, which provides the transition between the sloping conical section and the axial lip section, is arcuate in cross section and has a radius of 1/16 to ¼ inch. It has been found that as the material used becomes thinner, the radius must be made larger. If the beaming forces were to be restricted or with a sharp angle at the juncture, the conical portion would buckle and wrinkle adjacent to the lip.

The invention comprehends providing a transition between the cone and the lip such that internal pressure forces tending to expand the conical section as well as the toroidal portion are utilized to produce a compressive force radially inwardly on the adhesive which together with the tensile forces tending to expand the upper end of the body portion ensures parallelism between opposing body and lip portions and thus precludes developing voids such as would produce leaking joints.

Furthermore, the invention comprehends making an adhesively bonded joint as an extremely narrow axial band on the order of 1/16 to ⅛ of an inch which is now feasible because of the compressive loading on the adhesive.

In steel cans to be comparable to the aluminum cans, the wall thickness of both the top and bottom sections of the can would be on the order of 2 to 2½ mils thick or 0.30 mm (0.0118 inch) thick which in Europe and particularly in Holland is identified as E5,6/5,6 (0.50) Flow Brightened Type and Temper DKK (Type D Killed) T52 BA (Temper).

Although the can is in no way restricted to formation from aluminum, as indicated by the possibility of utilizing even thinner gauge steel, for the present it would appear that the best commercial aspects are with respect to a can formed of aluminum, and for that reason there has been established a can deemed most suitable for commercialization and that can, as well as various modifications of the can, have been subjected both to analytical and experimental tests. These tests clearly indicate that a specific relationship of the dome to the body provides for maximum strength with a minimum usage of metal and at the same time assures the formation of a lap bond between the body and the dome which will not be subject to rupture under all expected conditions.

With the above and other objects in view that will hereinafter appear, the nature of the invention will be more clearly understood by reference to the following detailed description, the appended claims, and the several views illustrated in the accompanying drawings.

IN THE DRAWINGS

Figure 11:
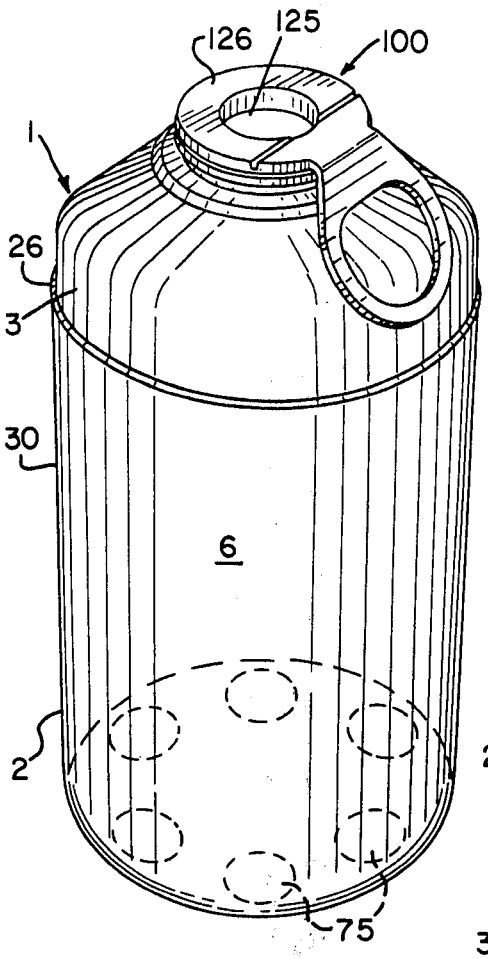
FIGS. 11–14 illustrate a further embodiment of the invention.
Figure 12:
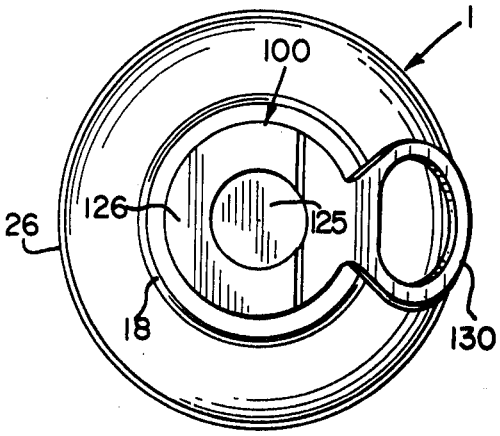
Figure 13:
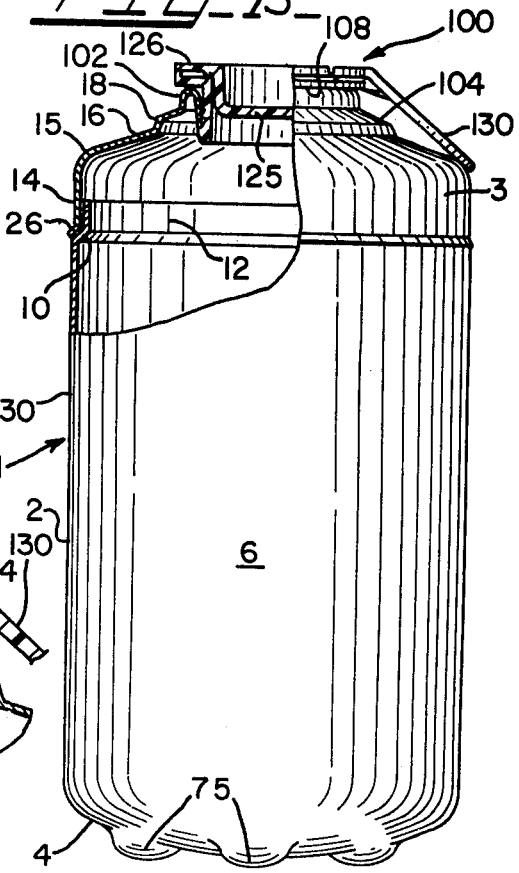
Figure 14:
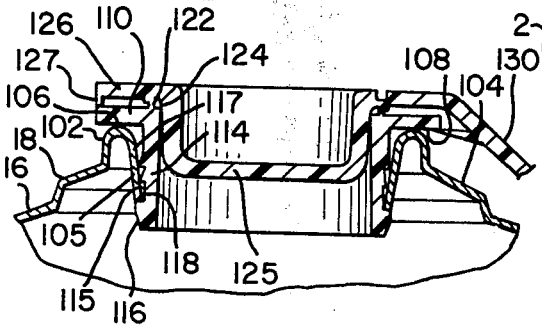

FIG. 11 being a perspective view;

FIG. 12 being a top plan view;

FIG. 13 being a side elevational view partly in vertical section taken substantially on line 13—13 of FIG. 12, and FIG. 14 is an enlarged portion of a part of FIG. 13.

Figure 15:
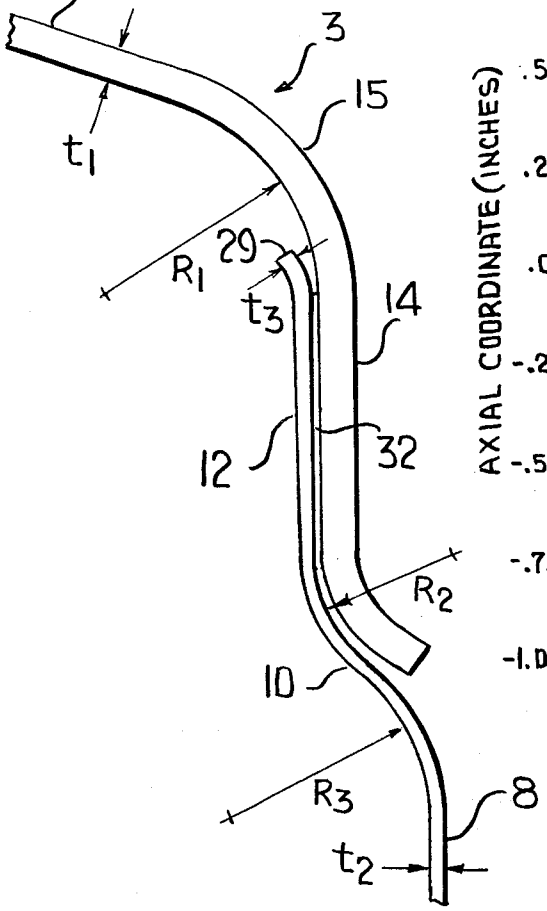

FIG. 15 is an enlarged fragmentary sectional view taken through the lap joint area of a preferred embodiment of dome and body relationship.

Figure 16:
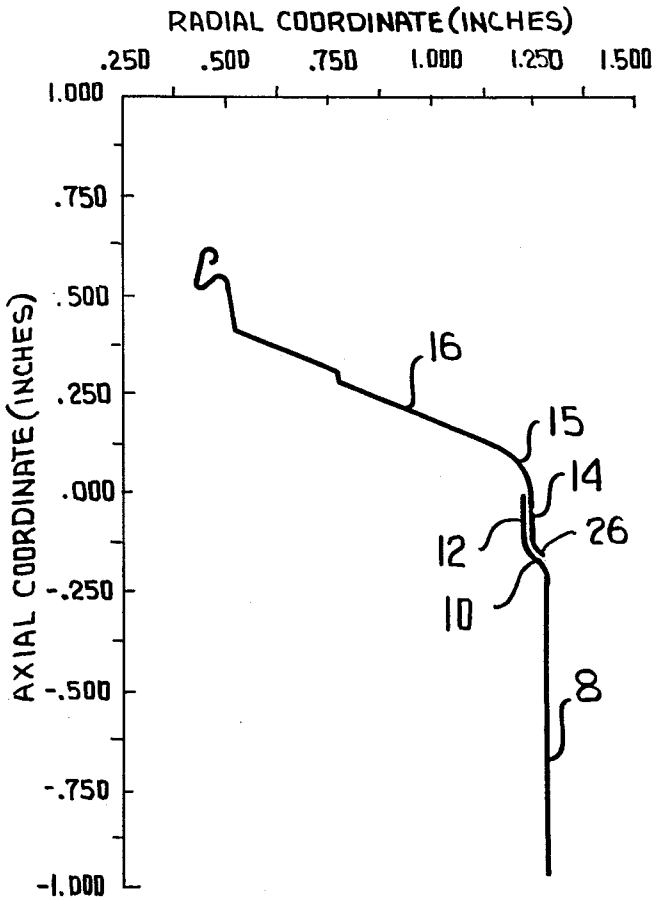

FIG. 16 is a schematic view showing the overall configuration of the dome and upper part of the body of a preferred embodiment.

Figure 17:
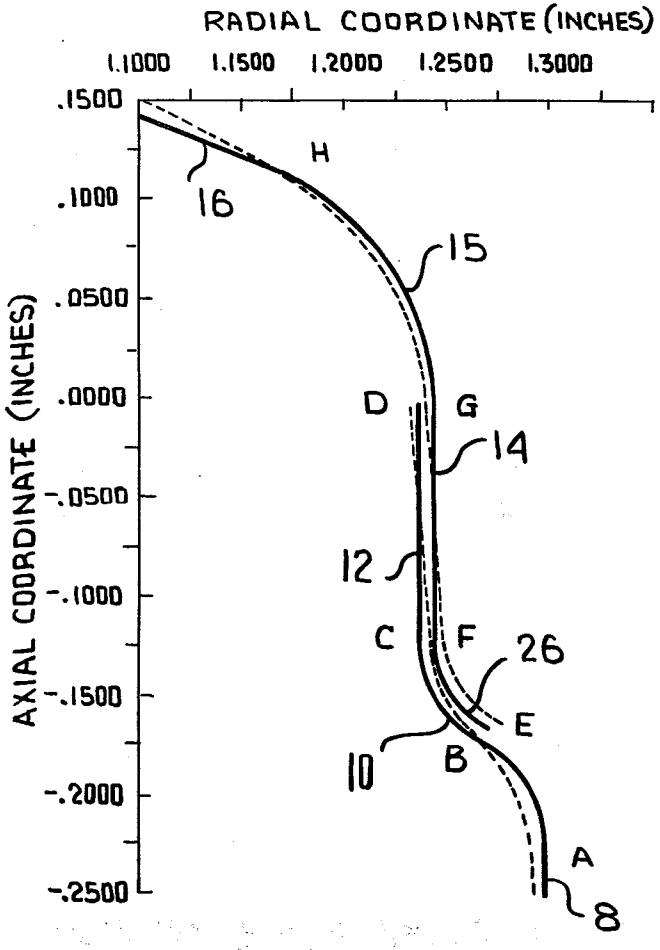

FIG. 17 is a plot comparing the deformation of the dome and body in the lap area under internal pressure with the undeformed can shape.

Figure 18:
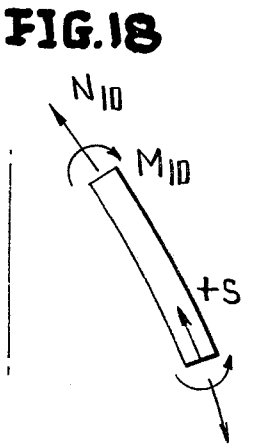

FIG. 18 is a schematic view indicating meridional forces considered during analysis.

Figure 19:
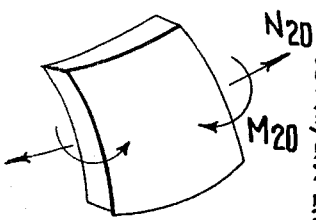

FIG. 19 is a schematic view showing circumferential forces considered during analysis.

Figure 20:
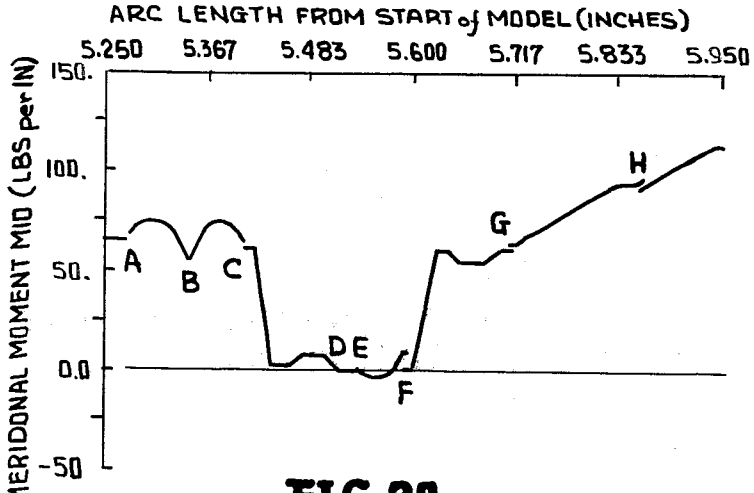

FIG. 20 is a plot of meridional forces in the dome and body of the can of FIG. 17 at the indicated locations.

Figure 21:
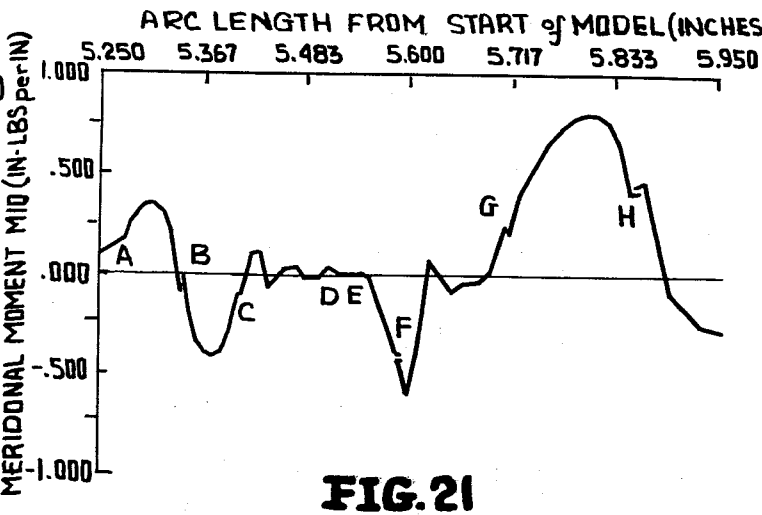

FIG. 21 is a plot of the meridional moments of the can of FIG. 17.

Figure 22:
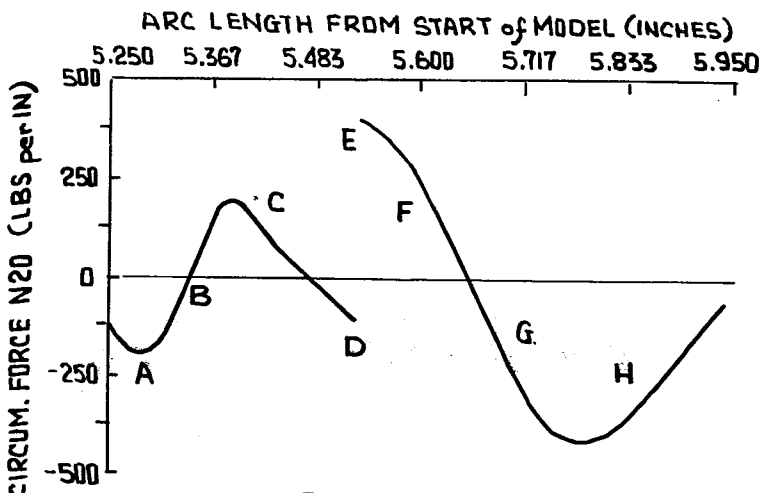

FIG. 22 is a plot of the circumferential forces of the can of FIG. 17.

Figure 23:
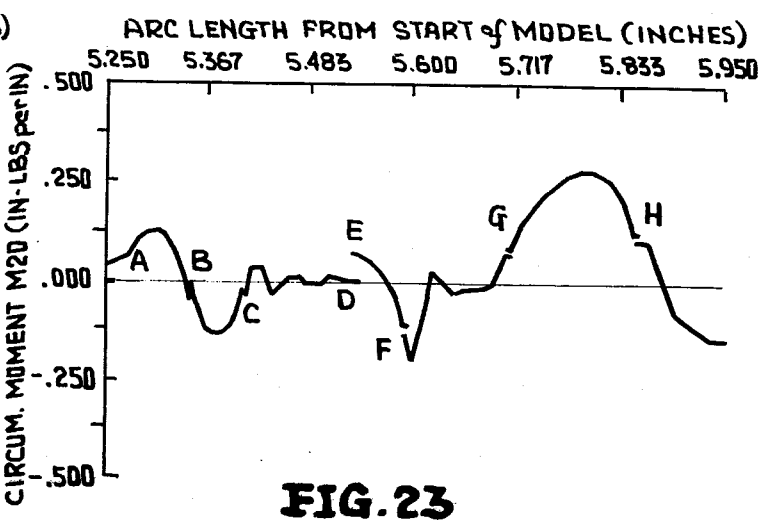

FIG. 23 is a plot of the circumferential moments of the can of FIG. 17.

Figure 24:
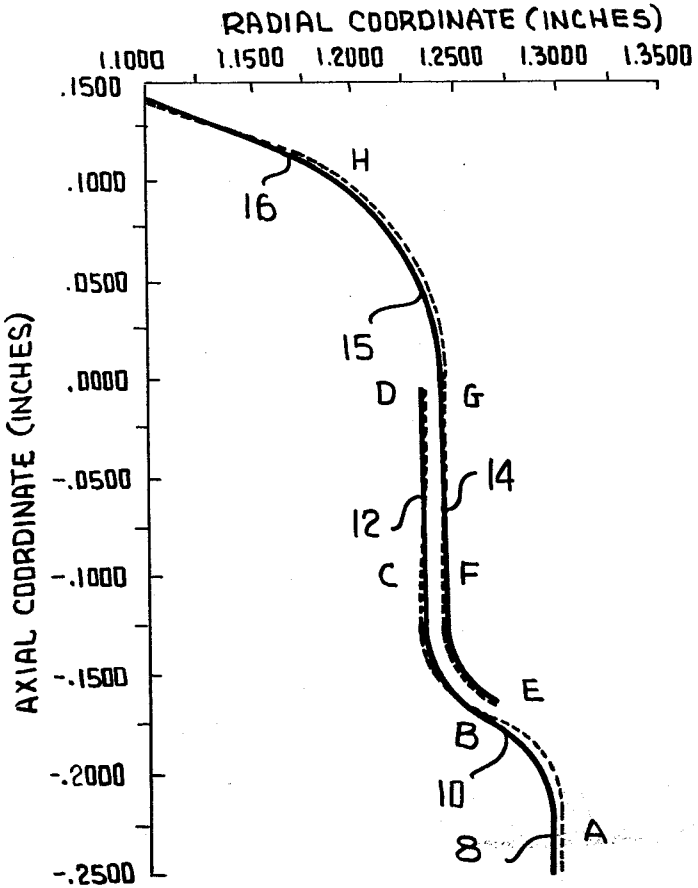

FIG. 24 is an enlarged fragmentary plot of the can of FIGS. 15 and 16 comparing the deformed shape with the original shape when the can is under an 80 pound axial fitment load.

Figure 25:
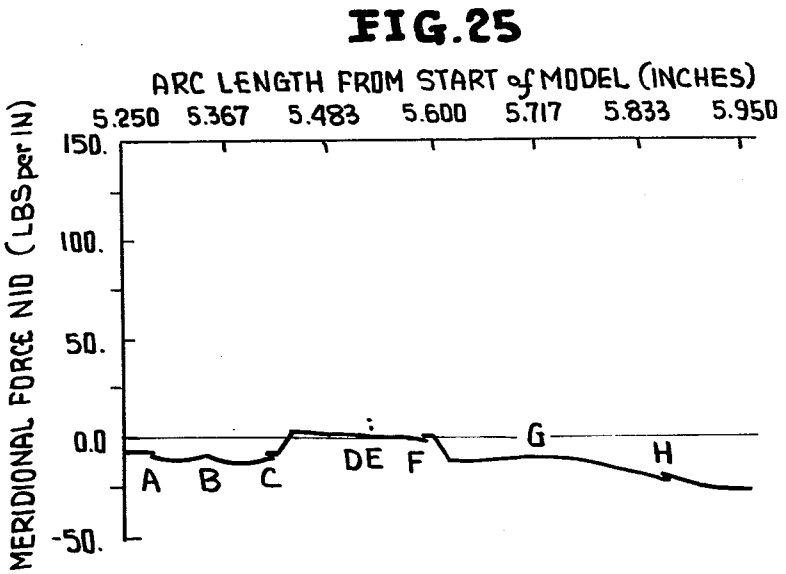

FIG. 25 is a plot of the meridional forces of the loaded can of FIG. 24.

Figure 26:
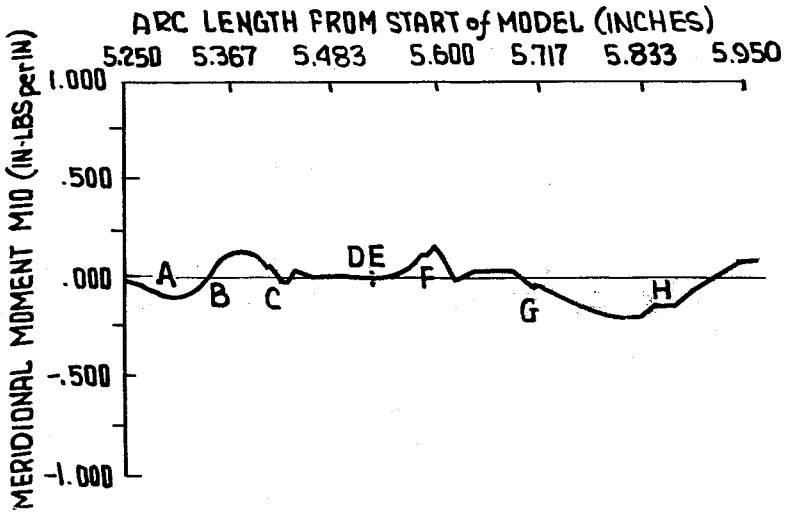

FIG. 26 is a plot of the meridional moments of the loaded can of FIG. 24.

Figure 27:
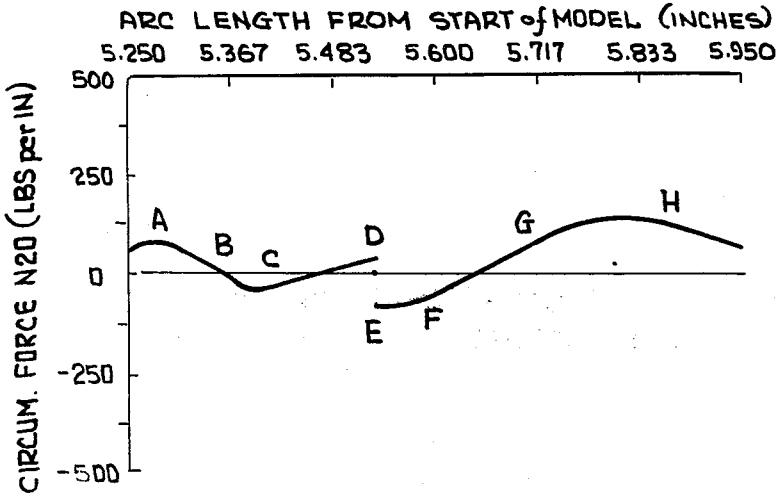

FIG. 27 is a plot of the circumferential forces of the can of FIG. 24.

Figure 28:
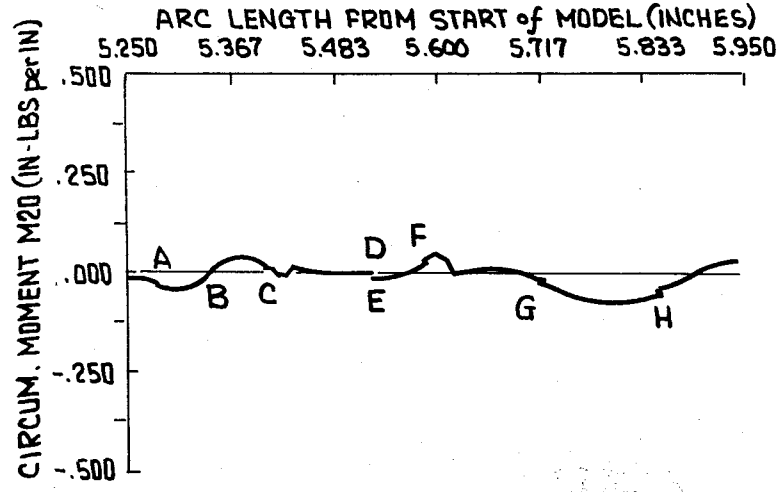

FIG. 28 is a plot of the circumferential moments of the can of FIG. 24.

Figure 29:
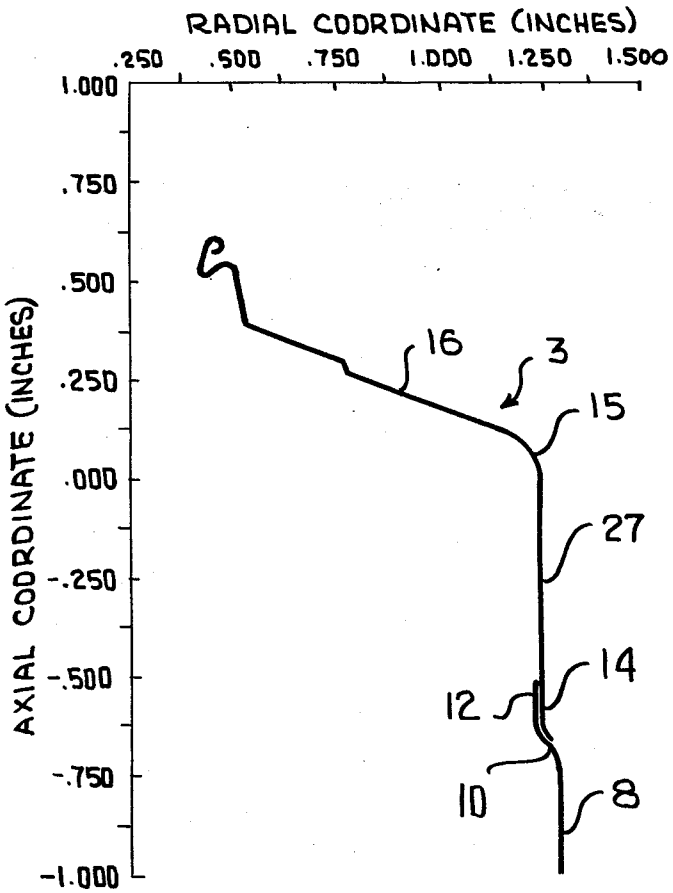

FIG. 29 is a schematic sectional view of a modified can geometry having a lowered lap joint.

Figure 30:
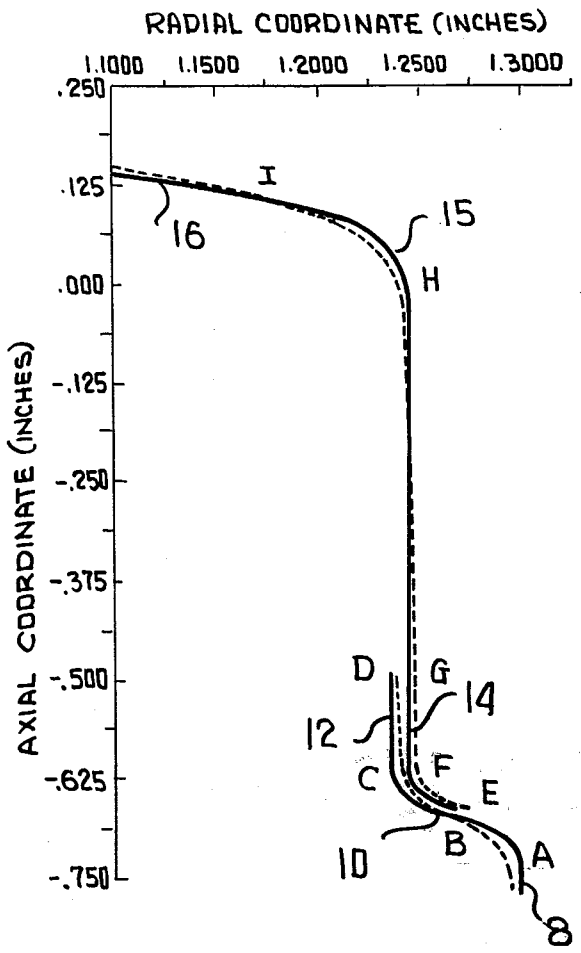

FIG. 30 is a plot of the deformed shape of the can of FIG. 29 under internal pressure as compared to the undeformed shape.

Figure 31:
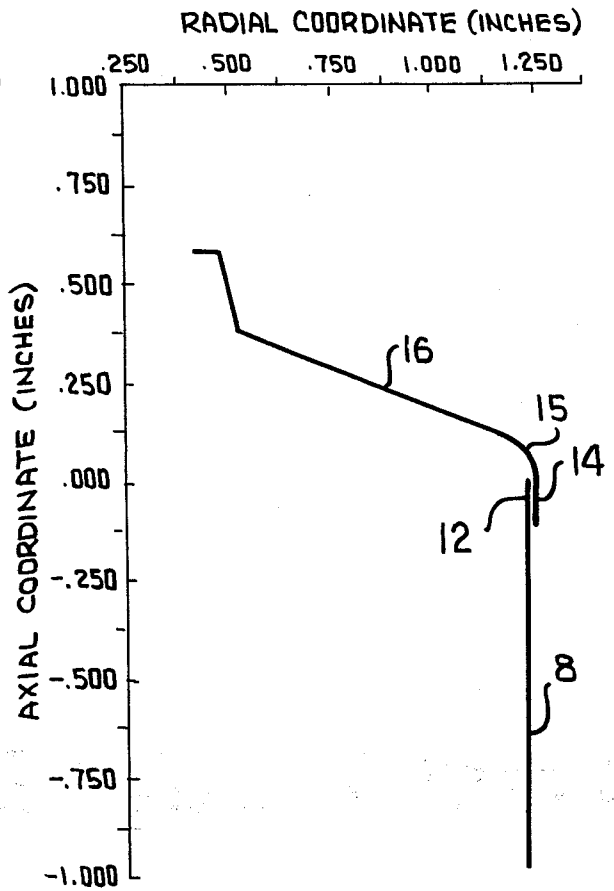

FIG. 31 is a schematic sectional view of another modified can shape wherein the body has a straight wall.

Figure 32:
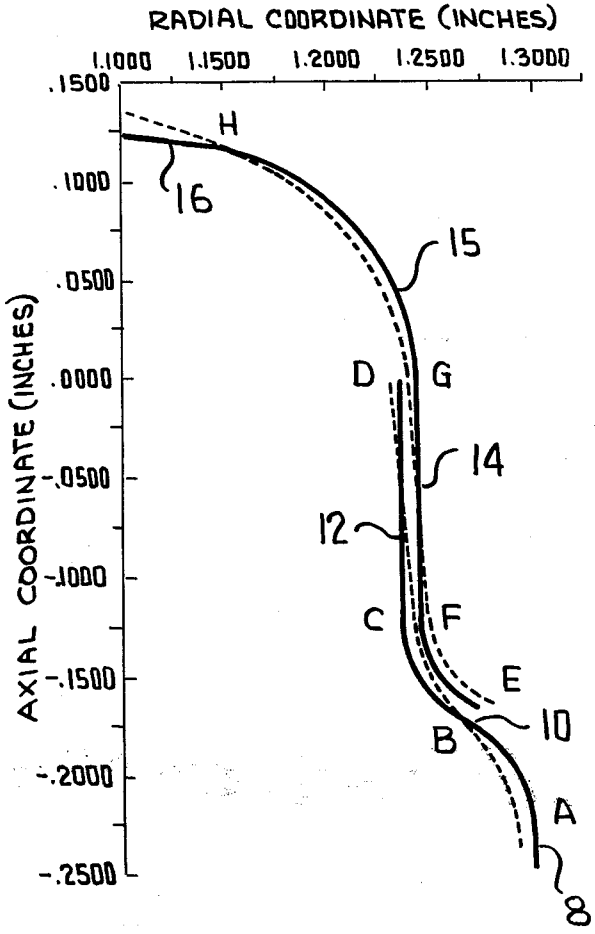

FIG. 32 is a plot of the can of FIGS. 15 and 16 with a decreased dome cone angle comparing the deformed shape of the can under internal pressure with the undeformed shape.

Figure 33:
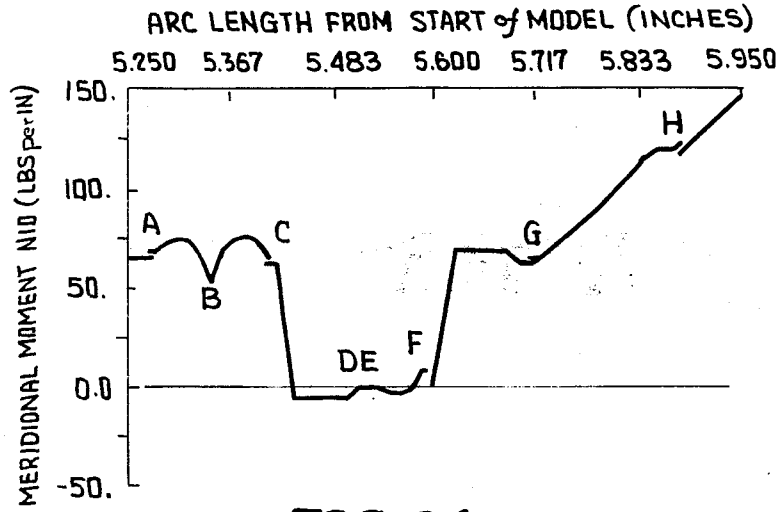

FIG. 33 is a plot of the meridional forces in the can of FIG. 32 at the indicated locations.

Figure 34:
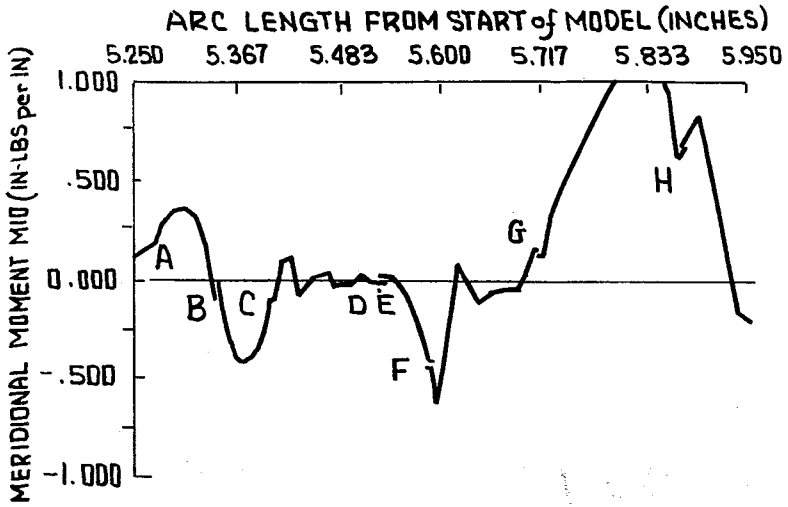

FIG. 34 is a plot of the meridional moments of the can of FIG. 32.

Figure 35:
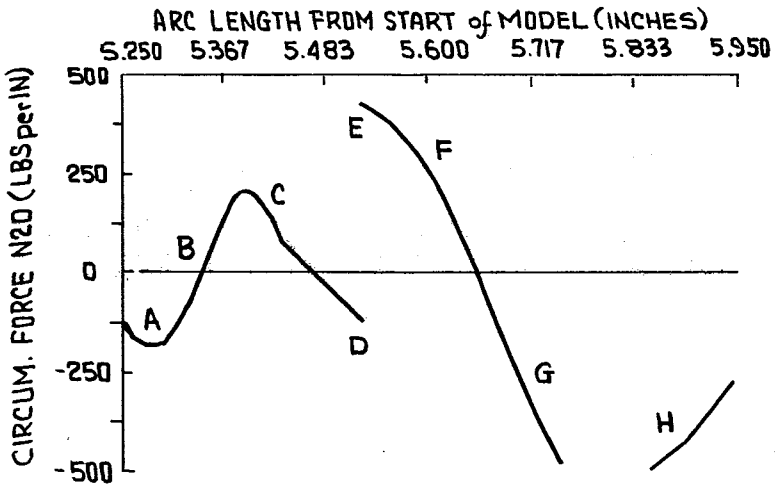

FIG. 35 is a plot of the circumferential forces on the can of FIG. 32.

Figure 36:
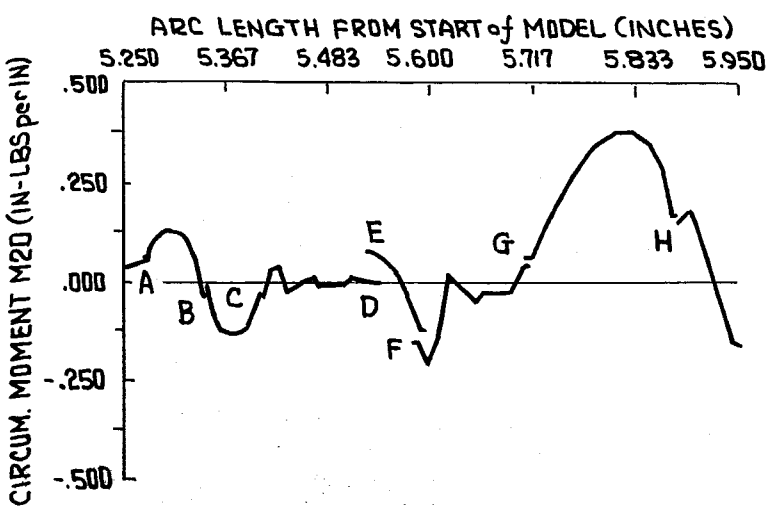

FIG. 36 is a plot of the circumferential moments of the can of FIG. 32.

Figure 37:
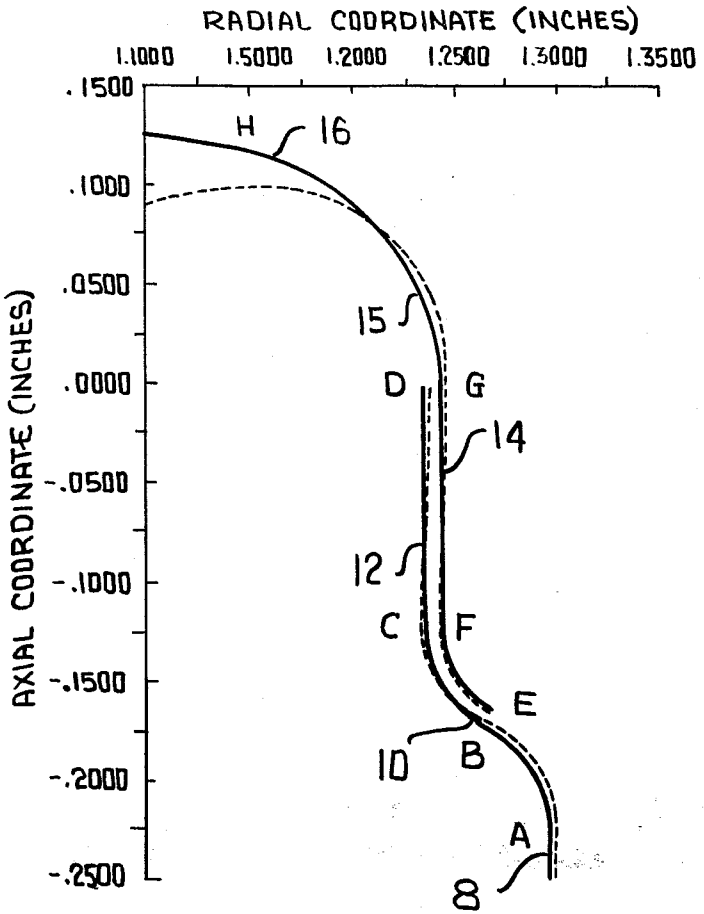

FIG. 37 is a plot of the can of FIG. 32 showing the deformed shape thereof under an 80 pound axial fitment load as compared to the undeformed shape.

Figure 38:
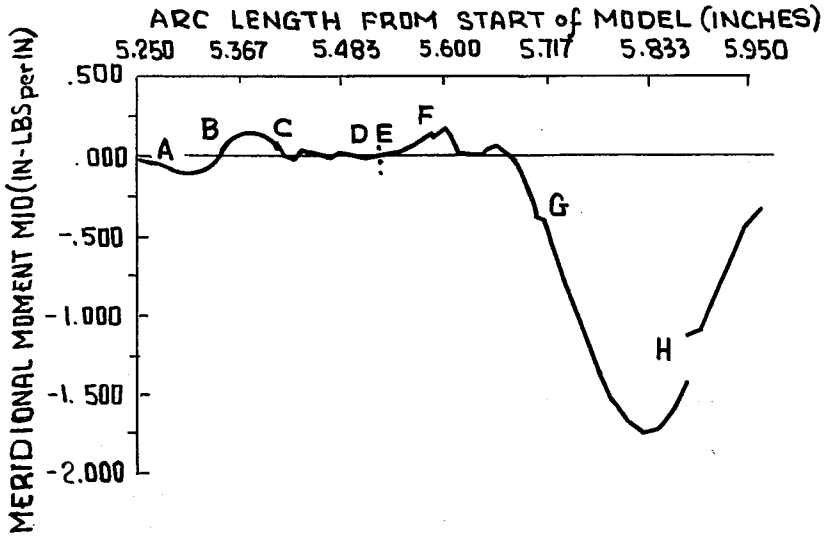

FIG. 38 is a plot of the meridional moments of the can of FIG. 37.

Figure 39:
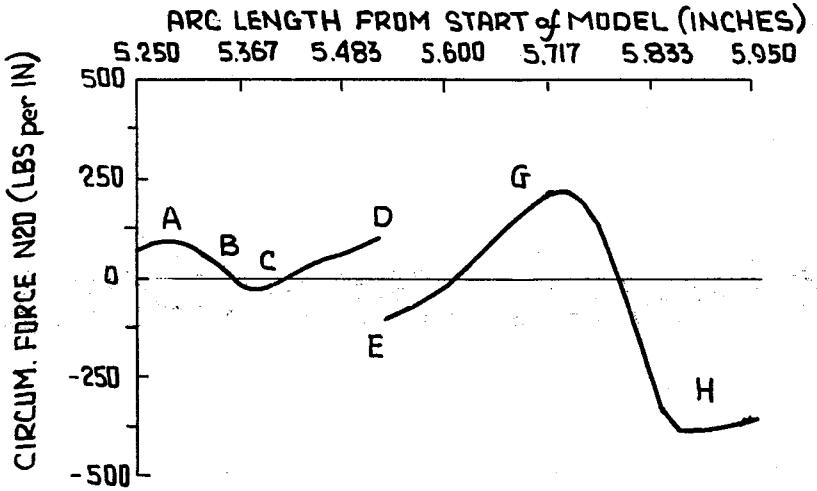

FIG. 39 is a plot of the circumferential forces of the can of FIG. 37.

FIG. 40 is a plot of the circumferential moments of the can of FIG. 37.

FIG. 41 is a plot of the meridional forces of a can similar to the can of FIG. 16, but wherein the dome toroidal radius has been decreased.

FIG. 42 is a plot of the meridional moments of the same can discussed in FIG. 41.

FIG. 43 is a schematic sectional view taken through the lap joint and shows the arrangement of adhesive segments utilized in obtaining the analysis data of TABLE II.

FIG. 44 is a schematic sectional view through the lap joint showing the use of a six segment adhesive arrangement utilized in obtaining a portion of the analysis data of TABLE III.

FIG. 45 is a schematic sectional view through the lap joint showing the use of a nine segment adhesive arrangement utilized in obtaining a portion of the analysis data of TABLE III.

Figure 46:
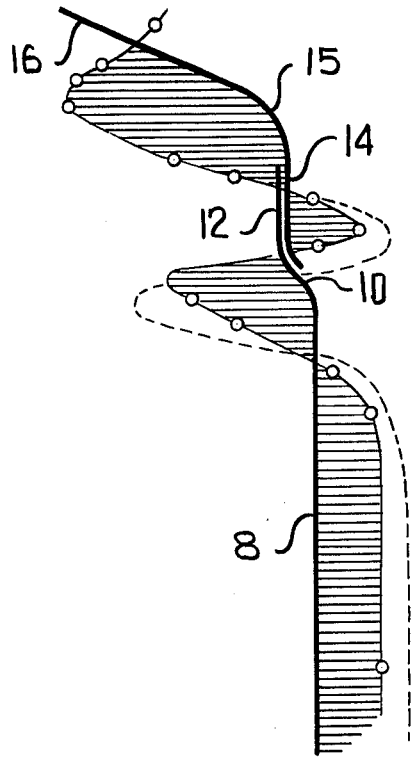

FIG. 46 is a plot showing the undeformed shape of the can of FIGS. 15 and 16 comparing the computer predicted displacement with respect to sensed displacements in a tested experimental can having an internal pressurized load.

Figure 47:
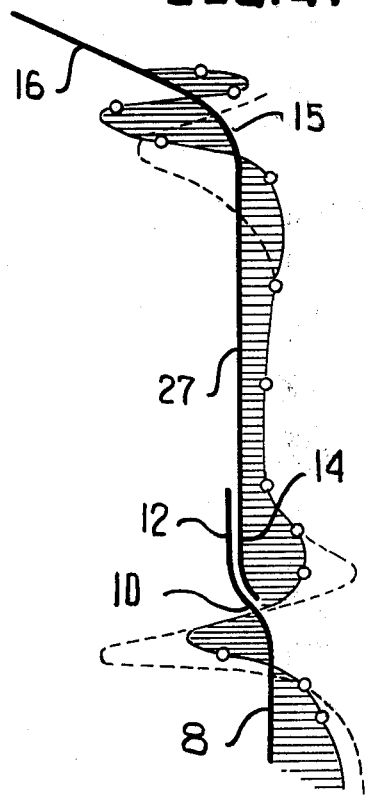

FIG. 47 is a plot of the modified can of FIG. 29 illustrating the undeformed can shape and a comparison of the computer predicted displacements with actual sensed displacements under an internal pressure load.

Figure 48:
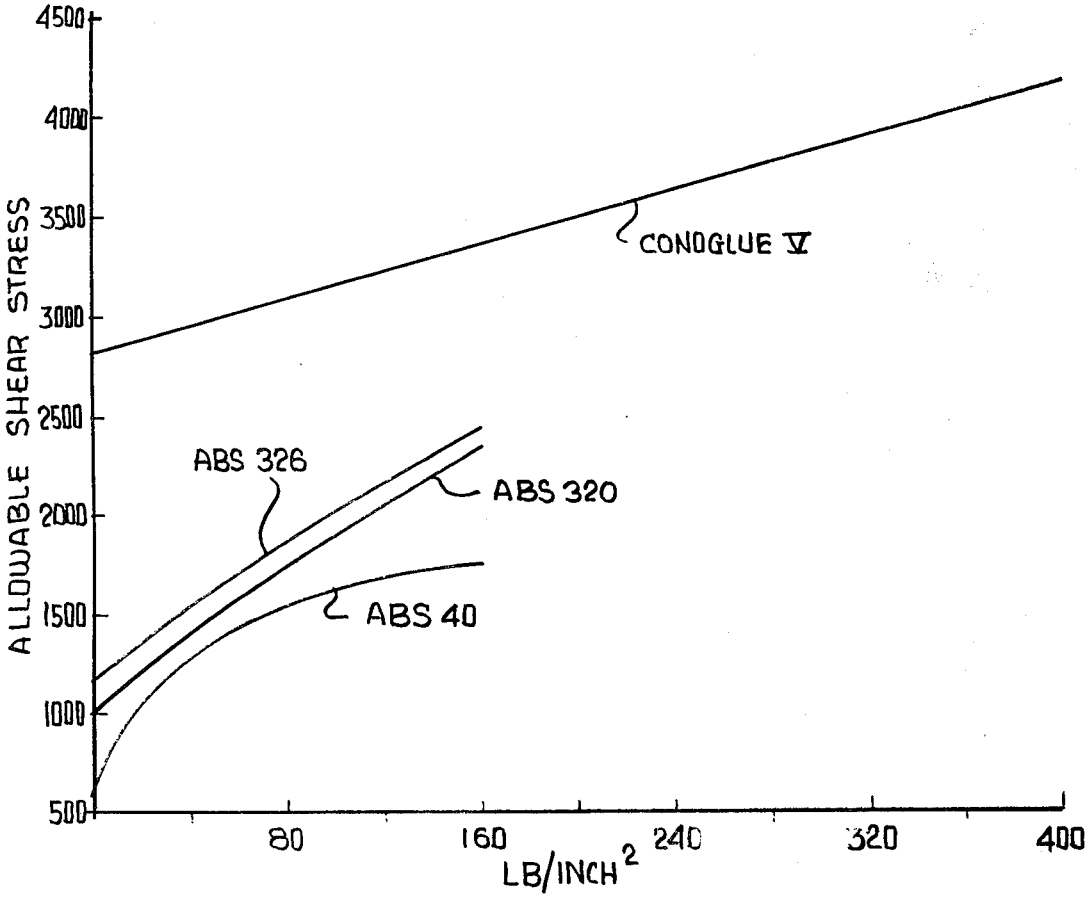

FIG. 48 is plots of allowable sheer stresses of different tested adhesives under a range of compressive loadings.

DESCRIPTION OF FIGS. 1-5 OF THE INVENTION

The invention as shown in FIGS. 1-5 of the drawings comprises a novel container, generally designated 1, preferably entirely formed of one alloy of aluminum such as H19-3004.

The container has a lower or bottom portion 2 and a top portion or dome 3. The lower portion 2 comprises a bottom 4 and an integral cylindrical body 6 which at its upper end 8 is necked-in to provide a radially inwardly extending shoulder 10 about 1/32 to 1/16 of an inch wide and about the inner edge of which there is an axially extending annulus or ring 12 of approximately $\frac{1}{8}$ of an inch in length.

Figure 2:
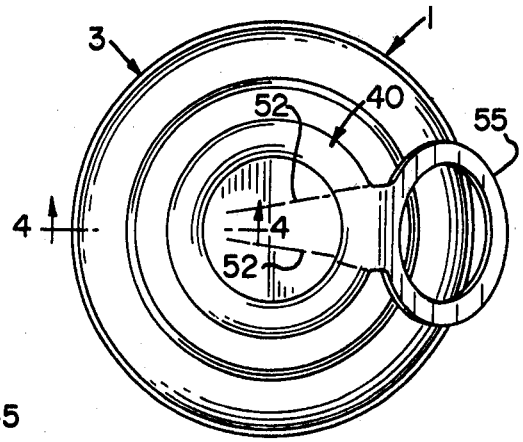
FIG. 2 is a top plan view thereof.
Figure 1:
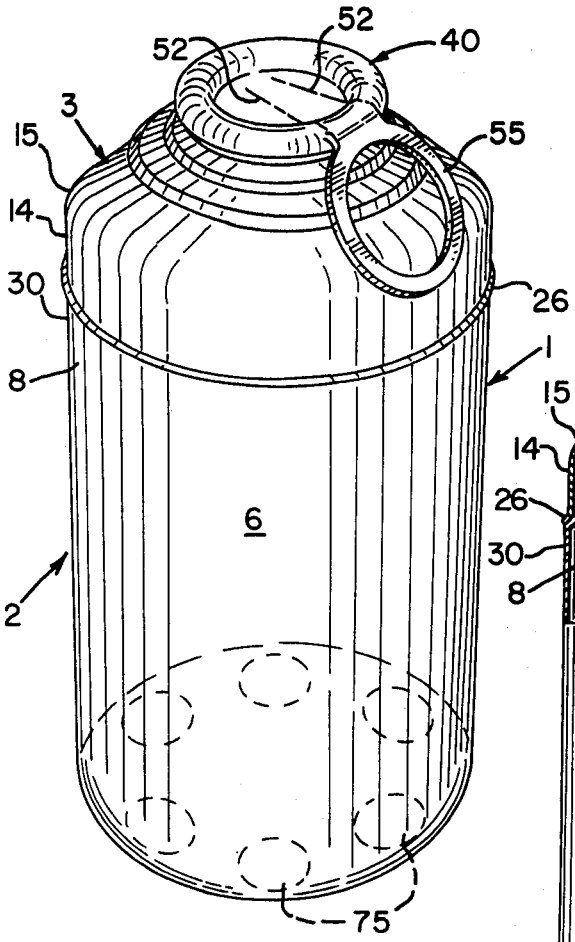
FIG. 1 is a perspective view of one embodiment of the invention.
Figure 3:
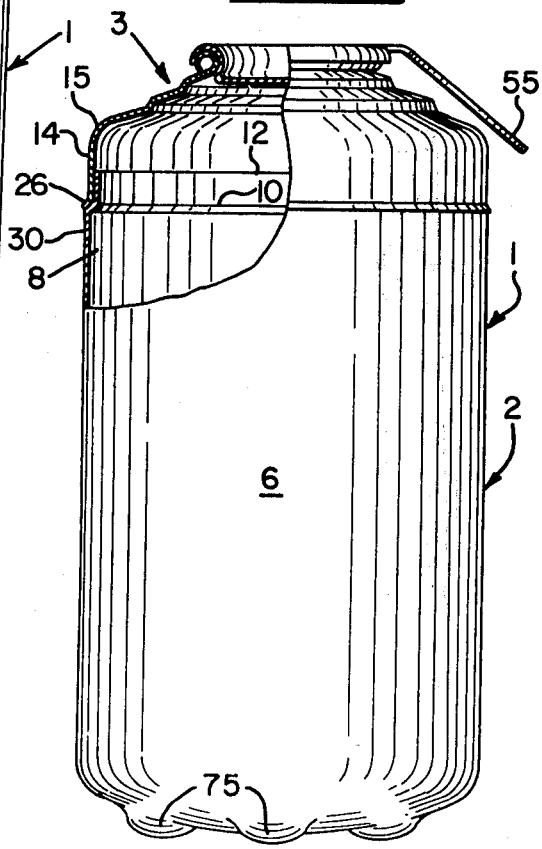
FIG. 3 is a side elevational view thereof shown partly in axial section.
Figures 4, 5, 6:
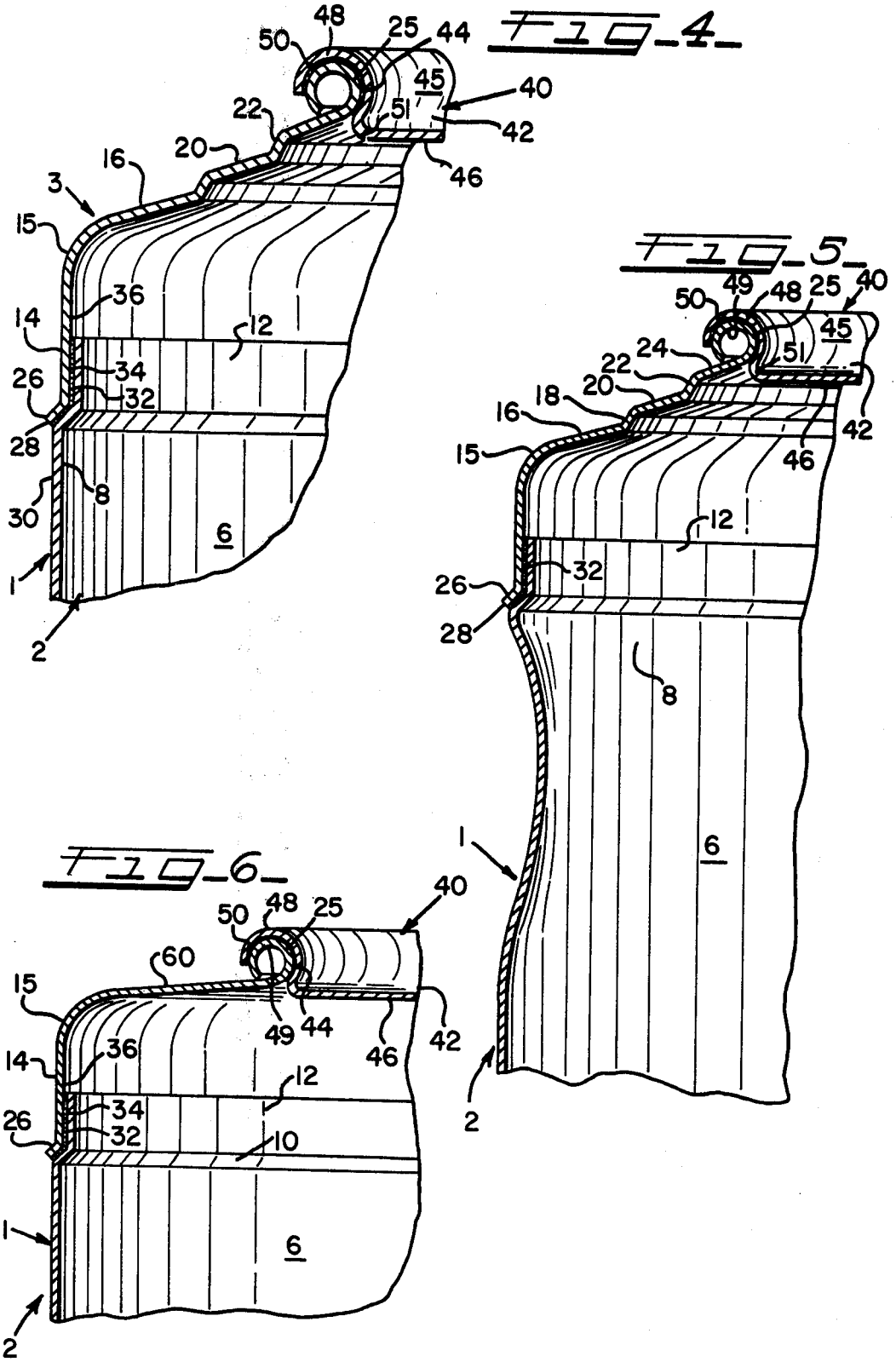
FIG. 4 is an enlarged fragmentary sectional view taken substantially on line 4—4 of FIG. 3.
FIG. 5 is a view similar to FIG. 5 showing the container wall portion partly inducted.
FIG. 6 illustrates a further embodiment incorporating a modified upper portion of the container.
Figure 7:
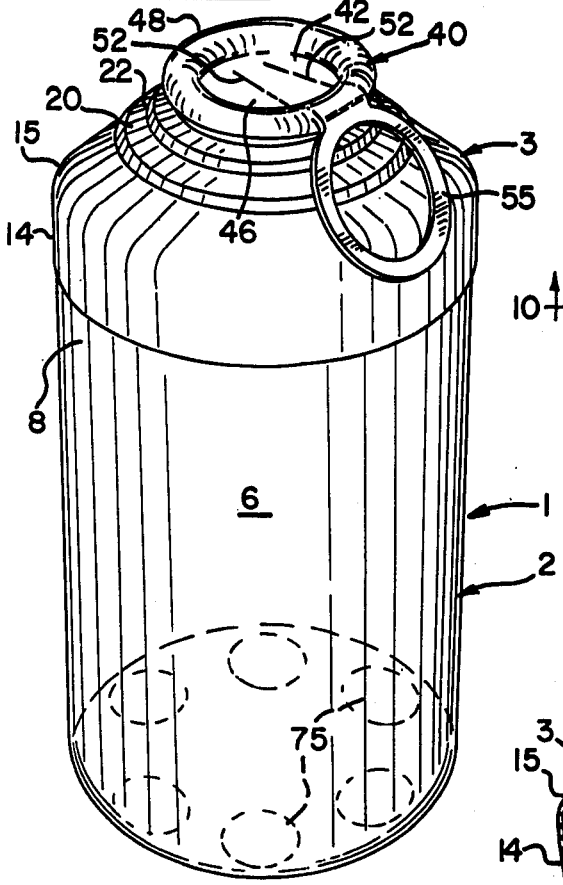
FIG. 7 is a perspective view illustrating a further embodiment of the invention.
Figure 8:
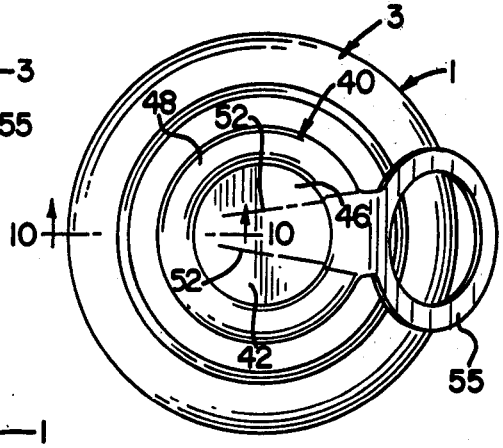
FIG. 8 is a top plan view thereof.
Figure 9:
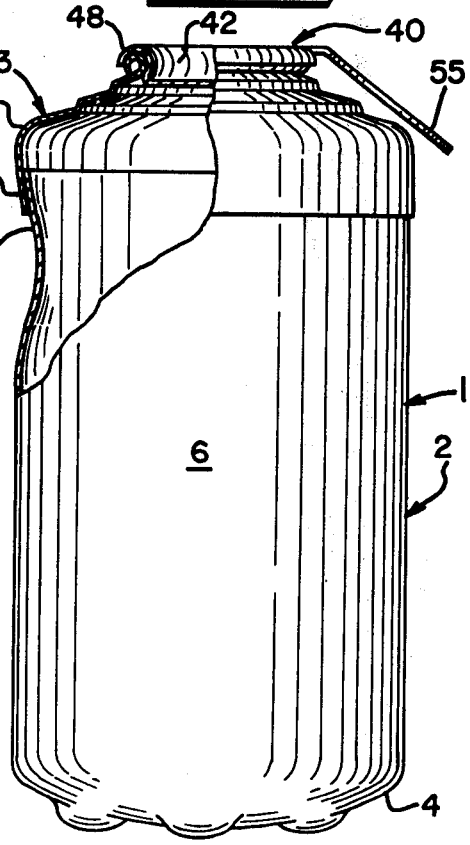
FIG. 9 is a side elevational view thereof partly in axial section.
Figure 10:
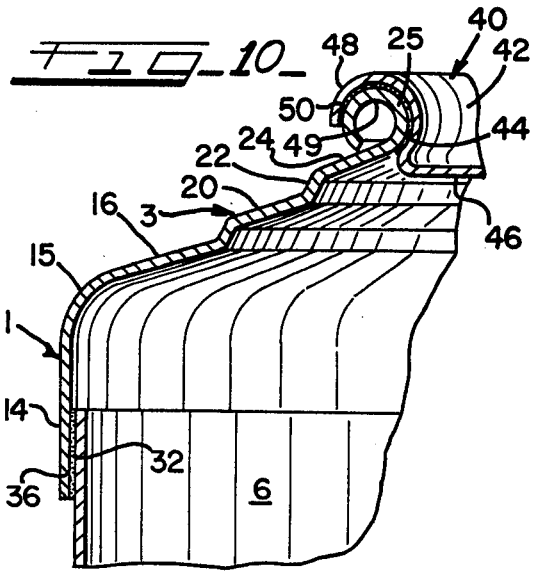
FIG. 10 is an enlarged cross section taken substantially on line 10—10 of FIG. 8.

The annulus or ring 12 preferably has a tight or interference fit into the lower end of an annular band or lip 14 of the dome 3 which is of an axial length corresponding to that of the ring 12 while the dome 3 is about 0.837 inch in total axial height. The upper edge of the lip 14 merges into the lower edge of a toroidal or arcuate transition section 15 which at its upper edge merges into the lower edge of a conical section 16. The section 15 has a radius of between 1/16 inch and $\frac{1}{4}$ inch. Preferably the thinner the metal, the greater the radius. The conical section 16 shown in FIGS. 1 and 5 is preferably of a stepped design and comprises a frustoconical annular band 18 which merges at its lower edge with the upper edge of the toroidal section 15 and the upper edge of the band 18 merges with the lower edge of a conical segment 20 which at its upper edge, in turn, merges into the lower edge of a second smaller frustoconical band 22. The band 22 has its upper edge merging into the lower edge of a second frustoconical section 24 which, at its upper edge, merges into a curl 25 which is turned outwardly over the second section 24.

The lower edge of the lip 14 is provided with an outturned downwardly flaring frustoconical or curled flange 26 which has an outer edge substantially coaxial with an external circular surface 30 of the body portion of the container. A preferably thermoplastic resin or adhesive 32 such as polyvinyl chloride and thermoplastic resin such as polyethylene or polypropylene or alternatively thermosetting epoxy resin, or vinyl plastisol is applied to an outer side 34 of the ring 12 and to an inner surface 36 of the lip prior to assembly of the dome to the lower portion so that after assembly the assembled can may be heated to a temperature melting the plastic adhesive during which time the top and bottom portions of the can may be relatively axially or circumferentially moved to eliminate any pinholes or the like formed in the adhesive and to promote good adhesion of the adhesive to the metal parts. Upon cooling, the adhesive 32 bonds the telescoped parts together.

In the instant invention, a metal closure 40 is shown in FIGS. 1-10 for purposes of illustration, it being understood that plastic closures of various kinds such as shown in FIGS. 11-13 may also be used. The closure comprises a center plug 42 which fits into the pour opening 44. The plug has an axially extending side wall 45 which at its lower end is connected to a bottom wall 46 and at its upper end has a downwardly open outward curl 48 which overlies the convex upper side 49 of the curl 25 and is drawn tightly against a foam gasket sealing material 50 applied thereto by mechanically crimping and expanding the side wall 45 of the plug to form a shoulder 51 under the curl.

The wall 46, side wall 45 and curl 48 are scored at 52, 52 and a ring type opener 55 is formed with the closure or cap and bent downwardly to extend generally parallel with the conical section of the upper portion. The closure is readily opened by lifting the ring 55 thus breaking the scores 52, 52 and thus lifting the closure out of the pour opening.

One of the features of the invention is that the side wall of the body portion of the can may be made of aluminum having a substantially uniform thickness on the order of 4 mils. The side wall thickness has been maintained substantially uniform from end to end, there being no necessity for a thick zone about the open end since the double seaming has been eliminated. It is, however, feasible to make the entire side wall of the container, except for the extreme top, of a metal thickness of about 4 mils and the bottom of about 4-8 mils. However, if desired, variable thicknesses may be incorporated in various zones of the side wall.

The novel telescoping arrangement of the lip of the top and the necked-in band of the bottom portion and the provision of the outturned flange on the lower edge of the lip has been found to provide exceptional resistance to impact breeching of the connection. The flange 26 materially improves the radial strength of the lip portion of the top and the configuration of the lip and toroidal and conical sections develop a compression loading on the connection which together with the radial shoulder and necked-in band of the lower section resist inward displacement and thus do not extend peel stresses to the adhesive.

This feature is amply illustrated in FIG. 5 wherein the body portion is depressed immediately below the necked-in region. The shoulder 10 stops the body from deflecting inwardly and thus prevents peeling of the adhesive. Furthermore, the thin metal top, upon being pressurized, when the can is filled with pressurized beverage, becomes a prehensible member and wants to expand its conical section into a sphere. This, in turn, loads the lip portion in compression which resists the expansion of the necked-in portion and holds the adhesive in compression therebetween.

EMBODIMENT OF FIG. 6

In this embodiment, as well as all others, parts which are identical with the other embodiments are identified by the same reference numerals.

As seen in FIG. 6, the top portion of the container is an unstepped conical section. In this embodiment the transition from the toroidal section 15 to the curl is a smooth single conical section 60 a design satisfactory depending on the stacking strength required of the container.

EMBODIMENT OF FIGS. 7-10

In this embodiment the necked-in structure at the upper end of the body section is eliminated and the upper end of the body portion 6 is a continuous cylinder which is slightly precompressed and fitted into the lip 14 of the top portion 3. The adhesive is thus held in compression between the lip 14 and the upper portion of the body 6.

In this embodiment the bottom and top portions of the container are generally of the same diametrical dimension. The bottom portion is precompressed about its upper edge portion 8 prior to insertion into the top lip 14 of the upper portion and then is released compressing the adhesive 32 between the inner surface of the lip and the outer surface of the upper portion 14. The adhesive is preferably a thermoplastic type such that after the container portion of any of the previous or subsequent embodiments are assembled and they are passed through a heating chamber, the adhesive melts and fuses the top and bottom portions into a unitary structure. In this embodiment it will be appreciated that the joint is flexible because of the wall thicknesses being of the order of 4–9 mils, preferably the former for the body portion 6, and the adhesive is flexible. Thus, when the container is struck with a side blow in the body wall adjacent to the joint, the extremely thin section of material, that is the metal and the plastic adhesive, allows the joint to flex inwardly thus attenuating the forces and inhibiting these forces from applying peeling loads on the adhesive and separating the inner portion from the lip.

EMBODIMENT OF FIGS. 11-14

In this embodiment the structure of the bottom portion 2 is the same as in the embodiments of FIGS. 1-5.

The top, however, is made to accommodate a different type of closure 100.

In this embodiment the neck 102 at the top of the stepped cone 104 is elongated and has an inturned frustoconical lip 105 which forms a smooth apical annulus 106 against which the bottom side 108 of a radial flange 110 of the plastic closure 100 seats.

The flange 110 is connected to a hollow sleeve 114 which fits into the lip 105 and has external sealing shoulders or rings 115 and 116. Shoulder 115 wedges against the top internal angular surface 117 of the lip 105 and the shoulder 116, which is at the bottom of the sleeve 114, underlaps the lower edge 118 of the lip 105 and tightly engages therewith. At the juncture of the upper end of the sleeve 114 and the flange 110 there is provided an integral tearable thin membrane 122 which is also integral with the outer peripheral edge portion 124 of a depressed closure plug 125 which is integrated with a hinge ring 126 connected by hinge 127 to the flange 110 and at the diametrically opposite side to a pull tab 130 which is angled downwardly toward the cone top portion. Lifting of the tab rips the membrane 122 and opens the container.

It will be noted that in each container the bottom 4 is convex and has feet 75. The bottom wall thickness is usually the initial thickness of the blank sheet preparatory to forming of the can, that is 10–6 mils, preferably 8 mils, thick. The body wall is ironed to about 5 mils or less. The top portion is also less than 10 mils thick, preferably 4–9 mils, and the pour opening is less than 30% of the bottom area. The angle of the conical portions is between 10–45 degrees, preferably 22½, in the stepped designs, as well as in the unstepped design of FIG. 6. However, to obtain greater axial strength, an angle of 45 degrees would be preferred, but that is dependent upon other desired parameters as will be described in more detail hereinafter. The stepped design greatly improves the axial strength of the top.

Steps have been taken to develop the can for commercialization utilizing aluminum as the metal. Cans such as that generally illustrated in FIGS. 1-5 have been developed, but with slight modifications in the wall thicknesses, radii, axial dimensions and the like. Reference is made to FIG. 15 which illustrates on a large scale the specifics of the dome and can body in the vicinity of the lap joint between the dome and the can body with respect to what has been considered to be the most efficient construction.

The dome 3 has a wall thickness t1 on the order of 9 mils. The can body 8 has a wall thickness t2 of 4 mils, but increases at its extreme upper end to a wall thickness t3 of 6 mils for a distance generally on the order of 0.06 inch. It is also to be noted that the extreme upper end of the body 8 is provided with a radially inwardly directed curl 29. The annulus 12 is radially inwardly offset and has an axial height on the order of 0.12 inch. The lip 14 has a like axial extent and the radius 15 has a preferred radius R1 of 1.12 inch. The extent of the radius 15 is such that the conical section 16 is disposed at an angle to the horizontal on the order of 22½ degrees.

The necking-in of the upper portion of the can body 8 provides a radially inward offset on the order of 0.06 inch with the shoulder 10 being joined to the ring 12 by a radius R2 to the remainder of the body 8 by a radius R3 which is also on the order of 0.06 inch. It is to be noted that the shoulder 10 slopes upwardly and radially inwardly between the body 8 and the ring 12.

A decision was made to make both analytical and experimental investigations of the can construction of FIG. 15 and modifications thereof. IIT Research Institute of 10 West 35th Street, Chicago, Ill. 60616 was selected to carry out the research.

The analytical research was by way of a computer program known as BOSOR 4 which is a computer program for the Buckling of Shells of Revolution. The program was developed by Lockheed Missile & Space Company, Sunnyvale, Cal.

The BOSOR computer program was used because it has been demonstrated extensively in the past that it is a reliable, accurate and efficient code for the elastic analysis of shells of revolution and has been extensively employed in the past both by IITRI personnel and personnal of the assignee of record of this application.

It was determined in advance that there are four conditions which could place loadings on the can which could be destructure. These are:

1. Internal pressurization loads which may be as high as 100 psi.

2. An axial loading applied to the dome during the application of the closure fitment and which may be as high as 80 pounds.

3. An axial loading which may be applied to the closure fitment during filling of a can.

4. A combined axial stacking loading and internal pressure loading. The latter two loadings were found not to be critical, and test results with respect thereto will not be set forth here.

Reference is made to FIG. 16 wherein there is illustrated the geometry of the can which corresponds to FIG. 15 and was considered as the basic can construction under consideration. In FIG. 17 there is illustrated both the original shape in solid lines and the deformed shape in dash lines of the can in the area of the joint between the body and the dome when the can was subjected to 100 psi internal pressure, the deformed can being traced out by the computer in accordance with the BOSOR 4 code.

Forces and moments in the body and in the dome were determined with respect to the meridional direction aa diagrammatically shown in FIG. 18 as well as circumferential forces and moments as diagrammatically shown in FIG. 19. With a permissible yield stress of 45, 800 psi, maximum permissible yield thrust in the body is calculated to be 183 lbs/inch and in the dome to be 412 lbs/inch, and the maximum permissible yield bending moment in the body to be 0.122 "lb/inch and in the dome to be 0.618 "lb/inch.

As is clearly shown in FIG. 20, the plotted meridional force at the various points A-H (FIG. 17) are well within the permissible range. The same is generally true of the meridional moments at the points A-H as plotted in FIG. 21. A graph of the circumferential forces at the points A-H is found in FIG. 22 wherein the forces are clearly shown to be within the permissible limit. The same is true of the circumferential moments as plotted in FIG. 23.

The can of FIGS. 15 and 16 was also theoretically subjected to an axial fitment load of 80 pounds with the dome and the body deflecting as shown by the dash lines in FIG. 24. It will be readily apparent that the meridional forces and the meridional moments under the 80 pound axial fitment load are negligible, as shown in FIGS. 25 and 26, respectively. The same is true of the circumferential forces and circumferential moments as shown in FIGS. 27 and 28, respectively.

Having established the can of FIGS. 15 and 16 as the preferred embodiment and thus as a standard, like internal pressure and axial fitment loading tests were run on other configurations. The modified shape parameters and a comparison of the results are found in TABLE I with the standard being identified by dashes and the modified shape parameters being compared with the standard with numeric identification from 1–4, with the numeral 1 showing the test results of the modified shape parameter being better than the standard; the numeral 2 showing the results to be the same as the standard; the numeral 3 indicating the test results of the modified shape to be worse than those of the standard; and the numeral 4 indicating test results which could possibly be critical including possible rupture or destructive failure of the dome or body.

TABLE I

| SHAPE PARAMETERS | FORCE AND MOMENTS 100 PSI MERIDIAN | FORCE AND MOMENTS 100 PSI CIRCUM. | FORCE AND MOMENTS AXIAL MERIDIAN | FORCE AND MOMENTS AXIAL CIRCUM. | RADIAL DEFLECTION OF ADHESIVE LAYER 100 PSI | RADIAL DEFLECTION OF ADHESIVE LAYER AXIAL | NORMAL STRESS IN ADHESIVE 100 PSI | NORMAL STRESS IN ADHESIVE AXIAL |
|---|---|---|---|---|---|---|---|---|
| Dome Angle | | | | | | | | |
| 10° | 3 | 3 | 3 | 3 | 1 | 3 | 2 | 3 |
| Present 22.5 | — | — | — | — | — | — | — | — |
| 45 | 1 | 1 | 2 | 2 | 3 | 1 | 2 | 2 |
| 90 | 2 | 2 | 2 | 2 | 3 | 1 | 3 | 1 |
| Dome Torus Radius | | | | | | | | |
| .06" | 3 | 3 | 2 | 2 | 1 | 2 | 1 | 3 |
| Present .12 | — | — | — | — | — | — | — | — |
| .24 | 1 | 1 | 2 | 2 | 3 | 1 | 3 | 1 |
| Dome Thickness | | | | | | | | |
| .004" | 3 | 3 | 4 | 4 | 1 | 3 | 3 | 4 |
| Present .009 | — | — | — | — | — | — | — | — |
| Lap Location | | | | | | | | |
| Present - At Tangent | — | — | — | — | — | — | — | — |
| ½" Below | 2 | 2 | 2 | 2 | 3 | 1 | 3 | 1 |
| Body Neck In | | | | | | | | |
| Present .060 Offset .06 Radius | — | — | — | — | — | — | — | — |
| .060 Offset .030 Radius | 2 | 3 | 2 | 2 | 1 | 2 | 3 | 1 |
| Not Necked | 2 | 2 | 2 | 2 | 1 | 2 | 3 | 1 |
| .12" Adhesive layer | — | — | — | — | — | — | — | — |
| Full Adhesive Layer | 2 | 2 | 3 | 2 | 2 | 3 | 3 | 1 |

Figure of Merit
Comparison with the Present Design
1 Better
2 Same
3 Worse
4 Possibly Critical It was found that having the lap between the dome and the body located immediately adjacent the toroidal radius 15 of the dome and having the body 8 necked-in produced the most desirable results. However, it was deemed advisable to change the lap location to be ½ inch below the dome radius to show the beaming effect of the dome on the lap and to connect the dome to a straight body to show the advantageous effect of the neck-in of the body on the lap.

Accordingly, a can was constructed as shown in FIG. 29 wherein the dome 3 included a cylindrical portion 27 having an axial length of 0.5 inch. As will be apparent from the deflection tracing, when the can of FIG. 29 is subjected to 100 psi internal pressure, the previously discussed beaming action has a lesser effect on the compression of the adhesive as shown in FIG. 30 and will be discussed hereinafter. On the other hand, the force and moments of this modified can construction are generally the same as those of the standard, as indicated in TABLE I. With respect to the absence of a body neck-in, a can as illustrated in FIG. 31 was considered. As shown in TABLE I, the force and moments under internal pressurization and axial fitment loading were generally the same as those of the sample of FIGS. 15 and 16. On the other hand, normal stresses in the adhesive under pressurization were below the standard as will be discussed in detail hereinafter.

It has therefore been concluded that the best possible combination is one wherein the lap is immediately adjacent the dome radius or toroidal curve, and there is a necking-in of the body. Returning now to FIG. 17, it will be seen that under internal pressurization the dome conical section 16 is angled upwardly to a greater extent and the radius 15 is deformed and moved radially inwardly so as to urge the upper portion of the lip 14 radially inwardly. At the same time the offset of the necked-in portion of the body tries to straighten out to eliminate the shoulder 10 and the lower portion of the ring 12 moves radially outwardly so as to compress the adhesive. The placing of the adhesive in compression has the obvious beneficial effect of preventing peel. It further has the unexpected advantageous effect that when the adhesive is placed under compression it has greater shear strength.

Having determined that the can configuration of FIGS. 15 and 16 was the most desirable, tests were made by modifying other shape parameters. For example, as indicated in TABLE I, dome angles of 10°, 45° and 90° were analytically tested. As shown in TABLE I, a dome angle of 10° is less desirable than a dome angle of 22.5° under both internal pressurization and axial fitment loading. As shown in the deflection diagram of FIG. 32, the deflection of the dome was greater under internal pressurization while the deflection of the body remained generally the same. Further, a comparison of the meridional forces and moments and axial forces and moments under internal pressurization approached the critical limits set for stresses and moments as is shown in FIGS. 33–36.

The decreased dome angle also resulted in undue downward deflection of the dome and an outward flexing of the dome lap to a point where it approached being critical under the 80 pound axial fitment loading as shown in FIG. 37. The critical or worse forces and moments under axial loading are also shown in FIGS. 38–40.

When the dome angle was changed to 45°, the forces and moments remained substantially the same as those of the standard, but under internal pressurization the radial deflection of the adhesive layer worsened as will be specifically indicated hereinafter.

In a like manner, when the dome angle was changed to 90°, which would result in a flat top and therefore not in accordance with the spirit of this invention, the forces and moments were generally the same as those of the standard, but both the radial deflection of the adhesive and the normal stress in the adhesive under internal pressurization worsened. This will be discussed hereinafter.

Analytical experimentation was conducted relative to the dome torus radius, decreasing it in one experiment to 0.06 inch and increasing it to 0.24 inch in another experiment. As is clearly shown in TABLE I, a reduced dome radius produced undesirable forces and moments when subjected to internal pressurization as shown in FIGS. 41 and 42. The stress in the adhesive was worse under axial loading.

When the dome radius was increased, the forces and moments calculated to be either better or the same as the standard, but under internal pressurization the radial deflection of the adhesive layer and the normal stress in the adhesive layer worsened, as will be discussed hereinafter.

When the thickness of the dome was reduced to 4 mils, the conditions worsened except for the radial deflection of the adhesive layer under internal pressurization. In fact, failure occurred when the dome was analytically subjected to the 80 pound fitment loading.

The can with a modified radius of the neck-in was analytically tested with a neck-in radius of 0.030 inch, and as is clearly shown in TABLE I, the results were not as good as when the radius was 0.060 inch.

The above described analytical tests were made by considering the total adhesive layer as being segmented into 3,6 or 9 smaller circumferential rings as shown in FIGS. 43–45. This segmentation was necessary to implement the computer code and permit a prediction of the compressive force distribution within the adhesive layer. Under these conditions test results of various body shape parameters relative to compressive forces on the adhesive were obtained as shown in TABLE II, as follows:

TABLE II

BOSOR 4 ADHESIVE RING SEGMENT RADIAL STRESSES, LB/IN$^2$ (+ = TENSION THREE RING SEGMENT MODEL

| | | Load Case | |
|---|---|---|---|
| Model | Adhesive Segment | 100 psi Internal Pressure | 80 lb. Axial Fitment Load |
| Original Configuration | U = Upper | −183 | 21 |
| | M = Middle | −178 | 23 |
| | L = Lower | −545 | 91 |
| Lowered Lap Joint (½") | U | −98 | 2 |
| | M | −143 | 14 |
| | L | −485 | 15 |
| No Body Neck | U | −169 | 19 |
| | M | −92 | −2 |
| | L | −66 | −8 |
| 90° Neck-In Body | U | −229 | 3.5 |
| | M | −21 | −25 |
| | L | −455 | 153 |
| Increase Dome Radius (0.12 → 0.24) | U | −133 | 8 |
| | M | −163 | 18 |
| | L | −510 | 94 |
| Decreased Dome Radius (0.12 → 0.06) | U | −282 | 38 |
| | M | −156 | 31 |
| | L | −578 | 98 |
| Increase Dome Radius with Less Neck-in | U | −122 | 7 |
| | M | −141 | 9 |
| | L | −318 | 39 |
| Increase Cone Angle (22.5° → 45°) | U | −188 | 16 |
| | M | −160 | 21 |
| | L | −525 | 96 |
| Decrease Cone Angle (22.5° → 10°) | U | −178 | 68 |
| | M | −192 | 47 |

TABLE II-continued

| BOSOR 4 ADHESIVE RING SEGMENT RADIAL STRESSES, LB/IN$^2$ (+ = TENSION THREE RING SEGMENT MODEL | | | |
|---|---|---|---|
| | | Load Case | |
| Model | Adhesive Segment | 100 psi Internal Pressure | 80 lb. Axial Fitment Load |
| | L | −570 | 102 |

Comparing the results of TABLE II with the merits of the different shapes of TABLE I, it will be seen that under all conditions the adhesive would be under compression when the can is subjected to 100 psi internal pressure. With respect to TABLE II, it is pointed out here that the analytical calculations were made without an interference fit and that based simplified calculations for the case of two infinetly long tubes with a 0.012 metal and adhesive fit assuming an adhesive thickness of 1 mil, there must be added to the compressive radial loadings of TABLE II 140 psi; when the metal and adhesive interference is 0.010 there must be added 117 psi; when the metal and adhesive interference is 0.06 there must be added 70 psi, and when the metal and adhesive interference is 0.002 there must be added 23 psi.

It will be seen that under 100 psi internal pressurization and without an interference fit, the adhesive under all circumstances is in compression although the results with respect to the standard can of FIGS. 15 and 16 are better or at least equal to all conditions except where the dome radius has been decreased to 0.060 inch. However, as discussed above, the reduced dome radius has criticality or worse results in other areas.

It is to be particularly noted that when there is no necking-in of the body, the compressive forces on the adhesive are greatly reduced.

The results set forth in TABLE II are believed to be readily understandable, and where there are worse adhesive conditions indicated in TABLE I, a comparison of the adhesive loading with respect to the test standard will clearly indicate the basis for the indicated worse conditions.

Other specific tests relative to adhesive loading were made using a six segment adhesive arrangement as shown in FIG. 44 when adhesive is applied only to the lap area, and a nine segment adhesive arrangement as shown in FIG. 45 when the adhesive is permitted to fill the space between the dome and the body below the lap area.

TABLE III

| BOSOR 4 ADHESIVE RING SEGMENT RADIAL STRESSES LB/IN$^2$ (+ = TENSION, − = COMPRESSION) | | | | |
|---|---|---|---|---|
| | | | Load Case | |
| Model | Adhesive Segment | | 100 psi Internal Pressure | 80 lb. Axial Fitment Load |
| Simplified Original | U | 0.120 | 240 | 28 |
| Geometry | 5 | Adhesive | −93 | 12 |
| 6 Segment Adhesive | 4 | Length | −9 | 6 |
| Layer | 3 | | −107 | 4 |
| Constant Body | 2 | | −219 | 24 |
| Thickness | L | | −1114 | 220 |
| Simplified Original | U ↑ | 0.120 | −129 | 17 |
| Geometry | 8 ↑ | Length | −90 | 10 |
| 9 Segment Adhesive | 7 ↑ | | −88 | 5 |
| Layer | 6 ↓ | | −90 | 4 |
| Constant Body | 5 ↓ | | −62 | −6 |
| Thickness | 4 ↓ | | −142 | −57 |

TABLE III-continued

| BOSOR 4 ADHESIVE RING SEGMENT RADIAL STRESSES LB/IN$^2$ (+ = TENSION, − = COMPRESSION) | | | |
|---|---|---|---|
| | | Load Case | |
| Model | Adhesive Segment | 100 psi Internal Pressure | 80 lb. Axial Fitment Load |
| | 3 | −1545 | −368 |
| | 2 | −2066 | −493 |
| | L | −1472 | −287 |

Referring to the foregoing TABLE III, it will be seen that when the adhesive fills the space between the dome and the body below the lap the compressive forces on the adhesive are greatly reduced under internal pressurization of the can and, in fact, in the lower part of the adhesive there are high tensile forces. While this would generally indicate that when the space between the dome and the body is filled with adhesive there is a poor joint, it is understood that even if that added adhesive should fail, the net result will be no less than that with the adhesive only in the lap in that the compressive forces on the remaining adhesive will increase to correspond to the case where there is adhesive only in the lap. On the other hand, the added adhesive will serve to prevent the entrance of foreign matter into the space between the lower edge of the dome and the body and thus does serve a useful purpose. Furthermore, because in the assembly of the dome and the body the adhesive is applied to the body ring 12 and there is an interference fit between the dome and the body, any extra adhesive on the body, and there will always be some, will flow into the lower part of the lap and thus fill the free space between the lower edge of the dome and the adjacent portion of the body.

The above described test results are all theoretical based upon the BOSOR 4 program. In view of the theoretical nature of the BOSOR 4 program, it was deemed advisable to double check the results by preparing test cans of configurations in accordance with inputs into the BOSOR 4 program and to apply to those test cans sensors which would provide information which could be compared with the results obtained with the BOSOR 4 program. Referring now to FIG. 46, it will be seen that there is plotted the analytical displacement in dash lines and the sensed displacement in a solid line, both superimposed over the original shape of the test can. It will be seen that the analytical (theoretical) and the sensed displacements favorably compared in FIG. 46 with respect to a can body construction of the type illustrated in FIGS. 15 and 16 so as to lend creditability to the results of the BOSOR 4 program.

Reference is also made to FIG. 47 wherein there is shown the analytical displacement and sensed displacement of a can body wherein the dome is provided below the toroidal radius a 0.5" high cylindrical portion. It will be seen that with respect to this can configuration the sensed deformation also closely corresponds to the analytical displacement, thereby further verifying the results of the BOSOR 4 program.

With reference to FIGS. 46 and 47, it is to be understood that at each of the circled points a sensor was bonded to the can prior to the can being internally pressurized and the displacements of the can were recorded by the sensors at the particular points. The sensors were bonded resistance strain gauges of a 0.015"

gauge length. The sensors were placed both internally and externally.

Reference is now made to FIG. 48 wherein there is plotted the shear stresses of different adhesives under various compressive loads. The results of testing by an independent test facility the allowable shear stresses of different adhesives under varied compressive loadings has resulted in the unexpected finding that, when an adhesive is under compression, even though that compression is only on the order of 400 psi, there may be a very marked increase in the allowable shear stress.

The values of adhesive loading in FIG. 48 correspond to the adhesive loadings of TABLE II and TABLE III, and it will be readily apparent that under the compressive loadings of adhesive in accordance with the can configuration of this invention, the adhesive has a much greater shear stress allowance than would normally be expected.

It will become apparent from the foregoing disclosure that novel lightweight pressure holding containers have been developed which adequately contain pressurized beverages, use a minimum amount of metal and strategically employ the metal to obtain a container of improved characteristics which constrain the forces to act in a favorable manner assisting in holding the adhesive bond from being breeched.

We claim:

1. A metal can comprising a body, a dome, and a lapped joint including an adhesive layer between said body and said dome, and the relationship between said body and said dome being one wherein when said can is filled with a liquid packaged under pressure said dome in the general area of said lapped joint radially inwardly deforms and said body in the general area of said lapped joint radially outwardly deforms with the combined deformation of said dome and said body compressing said adhesive layer, said relationship between said dome and said body including said dome having a lower cylindrical lip, said lip merging at its upper edge into a toroidal curve which merges into a conical radially inner and axially upper portion, said body having an axially upper portion telescoped within said lip with an axially upper free edge of said body terminating within said lip adjacent said toroidal curve, and wherein under internal pressure said conical portion is deformed generally axially upward and said toroidal curve is deformed radially inward with an associated tilting of said lip including a radially inward deformation of at least an axially upper portion of said lip and compression of an upper part of said adhesive layer.

2. A metal can according to claim 1 wherein said dome is of a greater wall thickness than said body wherein the resistance of said dome at said lapped joint to radially outwardly directed deformation is greater than that of said body.

3. A metal can according to claim 2 wherein said body and said dome are both formed of aluminum, said dome has a wall thickness on the order of 0.009 inch and said body has a wall thickness on the order of 0.004 inch.

4. A metal can according to claim 1 wherein said conical portion is disposed at an angle to the horizontal generally ranging from 10 degrees to 45 degrees.

5. A metal can according to claim 1 wherein said conical portion is disposed at an angle to the horizontal generally on the order of 22.5 degrees.

6. A metal can according to claim 1 wherein an upper end portion of said body is necked-in to define a radially inwardly offset upper ring connected to an adjacent portion of said body by a radially inwardly and axially upwardly sloping shoulder, and internal pressure within said can functioning to straighten out said body in the general area of said shoulder to deform at least a lower portion of said ring radially outwardly to compress at least a lower part of said adhesive layer.

7. A metal can according to claim 6 wherein the axial extents of said lip and said ring are generally the same, and said lip and said ring are in full overlapping relation.

8. A metal can according to claim 6 wherein said dome terminates in a lowermost radially outturned curl and said curl overlies said shoulder within an axial extension of said body, said curl forming means facilitating telescoping of said lip and said ring.

9. A metal can according to claim 8 wherein said adhesive layer extends between said curl and said shoulder.

10. A metal can according to claim 6 wherein said body terminates in an uppermost radially inwardly directed curl, said curl forming means facilitating telescoping of said lip and said ring.

11. A metal can according to claim 6 wherein there is an interference fit between said lip and said ring wherein in a non-loaded state of said can said adhesive layer is in a compressed state.

12. A metal can according to claim 6 wherein said body and said dome are both formed of aluminum, said dome has a wall thickness on the order of 0.009 inch and said body has a wall thickness on the order of 0.004 inch.

13. A metal can according to claim 1 wherein said body has a bottom, and said dome has a fitment receiving opening, said opening having an area less than 30 percent of the area of said bottom.

14. A metal can according to claim 1 wherein said adhesive is a flexible adhesive.

15. A metal can according to claim 1 wherein said conical portion has at least one annular step.

16. A metal can according to claim 1 wherein said dome has a short axial length as compared to said body.

17. A metal can according to claim 1 wherein said can is formed of sheet steel.

18. A metal can according to claim 1 wherein said body is formed of sheet steel having a thickness no greater than 0.002 inch.

19. A metal can according to claim 1 wherein said body is formed of sheet steel having a thickness on the order of 0.003 inch.

20. A metal can according to claim 1 wherein said body, said dome and said lapped joint all can sustain an 80 pound axial load in the empty can state and an internal pressure of 100 psi.

21. A metal can according to claim 20 wherein said body and said dome are both formed of aluminum, said dome has a wall thickness on the order of 0.009 inch and said body has a wall thickness on the order of 0.004 inch.

22. A metal can according to claim 1 wherein said adhesive is of the type wherein the shear strength increases with compression of said adhesive.

23. A thin metal can for pressurized beverages comprising a body a dome and a lapped joint having an adhesive layer between said body and said dome, the relationship between said body and said dome including the thinness of the metals thereof being one wherein when said can is filled with a beverage liquid packaged under pressure said dome in the general area of said lapped joint has radially inwardly deforming forces thereon and said body in the general area of said lapped joint has radially outwardly deforming forces thereon with resulting relative deformation of said body and said dome toward each other in said lapped joint compressing said adhesive layer, said relationship between said dome and said body including said dome having a lower cylindrical lip, said lip merging at its upper edge into a toroidal curve which merges into a conical radially inner and axially upper portion, said body having an axially upper portion telescoped within said lip to provide said lapped joint with an axially upper free edge of said body terminating within said lip sufficiently adjacent said toroidal curve that internal pressure on said conical portion causes generally axially upward deforming forces with said toroidal curve to be deformed radially inward and with an associated radially inward movement of at least an axially upper portion of said lip while the internal pressure causes radially outward forces on the telescoped upper portion of said body thereby resisting inward movement of said lip and the resulting compression of at least an upper part of said adhesive layer.

* * * * *

UNITED STATES PATENT AND TRADEMARK OFFICE

CERTIFICATE OF CORRECTION

PATENT NO. : 4,417,667

DATED : November 29, 1983

INVENTOR(S) : Donald J. Roth

It is certified that error appears in the above-identified patent and that said Letters Patent is hereby corrected as shown below:

On the title page Inventors should read

-- (75) Inventor: Donald J. Roth, Westport, Conn. --;

Signed and Sealed this

*Twenty-eighth* Day of *February 1984*

[SEAL]

*Attest:*

GERALD J. MOSSINGHOFF

*Attesting Officer*

*Commissioner of Patents and Trademarks*